US009061255B2

(12) United States Patent
Song et al.

(10) Patent No.: US 9,061,255 B2
(45) Date of Patent: Jun. 23, 2015

(54) ROTATING UNIT-BASED MICRO-SIZED BUBBLE GENERATOR

(75) Inventors: Dong Kuen Song, Daejeon (KR); Won-Seok Hong, Daejeon (KR); Wan-Ho Shin, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 163 days.

(21) Appl. No.: 13/637,730

(22) PCT Filed: Jul. 15, 2011

(86) PCT No.: PCT/KR2011/005247

§ 371 (c)(1), (2), (4) Date: Sep. 27, 2012

(87) PCT Pub. No.: WO2012/008805

PCT Pub. Date: Jan. 19, 2012

(65) Prior Publication Data

US 2013/0113125 A1 May 9, 2013

(30) Foreign Application Priority Data

Jul. 15, 2010 (KR) ..... 10-2010-0068725
Jul. 16, 2010 (KR) ..... 10-2010-0068759
Jul. 15, 2011 (KR) ..... 10-2011-0070322
Jul. 15, 2011 (KR) ..... 10-2011-0070336

(51) Int. Cl.
*B01F 3/04* (2006.01)
*B01F 5/00* (2006.01)
(Continued)

(52) U.S. Cl.
CPC ..... *B01F 3/04106* (2013.01); *B01F 3/0451* (2013.01); *B01F 5/0065* (2013.01);
(Continued)

(58) Field of Classification Search
CPC ..... C02F 3/20; B01F 3/04758; B01F 3/0451; B01F 3/04106; B01F 3/0876; B01F 5/0606; B01F 5/0615; B01F 5/0065; B01F 5/0696; B01F 5/20
USPC ..... 261/83
See application file for complete search history.

(56) References Cited

U.S. PATENT DOCUMENTS 1,717,713 A * 6/1929 Logan ..... 261/122.1
2,144,385 A * 1/1939 Nordell ..... 210/629
(Continued)

FOREIGN PATENT DOCUMENTS

JP 11-005080 1/1999
JP 11-207162 8/1999
(Continued)

OTHER PUBLICATIONS

PCT Search Report—Written Opinion, PCT/KR2011/005247 filed on Jul. 15, 2011.

*Primary Examiner* — Duane Smith
*Assistant Examiner* — Stephen Hobson
(74) *Attorney, Agent, or Firm* — Lexyoume IP Meister, PLLC

(57) ABSTRACT

The present invention relates to a micro-sized bubble generator. A micro-sized bubble generator using a highly-dissolved solution based on a rotating unit according to an exemplary embodiment of the present includes: a rotating unit receiving a mixture of water and gas and discharging a solution while making the water and gas collide with each other and rotating the same; a dissolving tank storing the solution discharged from the rotating unit; and a nozzle unit receiving the solution and generating micro-sized bubbles in the water. Accordingly, a massive amount of micro-sized bubbles less than 100 nm in size can be generated.

16 Claims, 50 Drawing Sheets

(51) Int. Cl.
*B01F 5/06* (2006.01)
*B01F 5/20* (2006.01)
*B01F 3/08* (2006.01)

(52) U.S. Cl.
CPC ..... *B01F5/0606* (2013.01); *B01F 5/0615* (2013.01); *B01F 5/0696* (2013.01); *B01F 5/20* (2013.01); *B01F 3/04758* (2013.01); *B01F 3/0876* (2013.01)

(56) References Cited

U.S. PATENT DOCUMENTS

| | | | | | |
|---|---|---|---|---|---|
| 2,328,655 | A * | 9/1943 | Lannert | 261/122.1 |
| 2,637,541 | A * | 5/1953 | Rubin | 261/122.1 |
| 2,650,810 | A * | 9/1953 | Nordell | 261/121.1 |
| 2,653,801 | A * | 9/1953 | De Gelder et al. | 366/139 |
| 2,719,307 | A * | 10/1955 | Reid | 119/673 |
| 3,174,733 | A * | 3/1965 | Chase | 261/124 |
| 3,424,443 | A * | 1/1969 | Thayer | 261/123 |
| 3,664,647 | A * | 5/1972 | Snow | 261/30 |
| 3,711,072 | A * | 1/1973 | Waldenville | 261/122.1 |
| 3,785,629 | A * | 1/1974 | McKinney | 261/122.1 |
| 3,864,441 | A * | 2/1975 | Suzuki | 261/122.1 |
| 4,029,581 | A * | 6/1977 | Clough et al. | 210/220 |
| 4,048,266 | A * | 9/1977 | Baumann | 261/122.1 |
| 4,294,696 | A * | 10/1981 | Thayer | 210/220 |
| 4,323,455 | A * | 4/1982 | Tanaka et al. | 210/321.75 |
| 4,474,714 | A * | 10/1984 | Downs | 261/124 |
| 4,929,397 | A * | 5/1990 | Jager | 261/65 |
| 5,587,114 | A * | 12/1996 | Tharp | 261/124 |
| 5,816,498 | A | 10/1998 | Smith, Jr. | |
| 5,843,307 | A | 12/1998 | Faivre | |
| 5,945,040 | A * | 8/1999 | Brauch et al. | 261/122.1 |
| 6,260,831 | B1 * | 7/2001 | Jager | 261/122.1 |
| 6,264,176 | B1 * | 7/2001 | Dickman et al. | 261/77 |
| 6,752,773 | B2 * | 6/2004 | Leung et al. | 601/158 |
| 6,863,810 | B2 * | 3/2005 | Chann | 210/220 |
| 6,964,741 | B2 * | 11/2005 | Mahendran et al. | 210/636 |
| 7,571,899 | B2 * | 8/2009 | Kitasako et al. | 261/29 |
| 7,862,014 | B2 * | 1/2011 | Lechner et al. | 261/122.1 |
| 7,934,704 | B2 * | 5/2011 | Tharp | 261/23.1 |
| 8,186,652 | B2 | 5/2012 | Matsumoto | |
| 8,556,238 | B2 * | 10/2013 | Kim et al. | 261/124 |
| 2004/0253183 | A1 * | 12/2004 | Uber et al. | 424/9.52 |
| 2005/0167858 | A1 * | 8/2005 | Jones et al. | 261/28 |
| 2006/0065987 | A1 * | 3/2006 | Schletz | 261/76 |
| 2007/0267334 | A1 * | 11/2007 | Osborn et al. | 210/97 |
| 2009/0117241 | A1 * | 5/2009 | Tsuji | 426/460 |
| 2013/0113125 | A1 | 5/2013 | Song | |

FOREIGN PATENT DOCUMENTS

| | | | |
|---|---|---|---|
| JP | 2002-273183 | 9/2002 | |
| JP | 2002-336668 | 11/2002 | |
| JP | 2003-340251 | 2/2003 | |
| JP | 2004-024931 | 1/2004 | |
| JP | 2004-130207 | 4/2004 | |
| JP | 2005-185665 | 7/2005 | |
| JP | 2005-193140 | 7/2005 | |
| JP | 2006-180829 | 7/2006 | |
| JP | 2007-111616 | 5/2007 | |
| JP | 2007-296420 | 11/2007 | |
| JP | 2008-161822 | 7/2008 | |
| JP | 2008-173631 | 7/2008 | |
| JP | 2008-246268 | 10/2008 | |
| JP | 2009-101263 | 5/2009 | |
| JP | 2009-112980 | 5/2009 | |
| JP | 2010-142760 | 7/2010 | |
| KR | 10-2002-0071432 | 9/2002 | |
| KR | 10-2006-0045618 | 5/2006 | |
| KR | 20-0418394 | 6/2006 | |
| KR | 10-0658165 | 12/2006 | |
| KR | 10-0745851 | 7/2007 | |
| KR | 10-0843970 | 6/2008 | |
| KR | 20-2008-0001577 | 6/2008 | |
| KR | 10-0900275 | 5/2009 | |
| KR | 10-2010-0030382 | 3/2010 | |
| KR | 10-2011-0029904 | 3/2011 | |
| KR | 10-2012-0007930 | 1/2012 | |
| WO | 2006/038298 | 4/2006 | |
| WO | WO 2007136030 A1 * | 11/2007 | B01F 3/04 |

* cited by examiner

ROTATING UNIT-BASED MICRO-SIZED BUBBLE GENERATOR

CROSS-REFERENCE TO RELATED APPLICATION

This application is a National Stage application of PCT/KR2011/005247 filed on Jul. 15, 2011, which claims priority to and the benefit of Korean Patent Application Nos. 10-2010-0068725, 10-2010-0068759, 10-2011-0070322, and 10-2012-0070336 in the Korean Intellectual Property Office on Jul. 15, 2010, Jul. 16, 2010, Jul. 15, 2011, and Jul. 15, 2011, the entire contents of which are incorporated herein by reference.

BACKGROUND OF THE INVENTION (a) Field of the Invention

The present invention relates to a micro-sized bubble generator based on a rotating unit. More particularly, the present invention relates to a rotating unit-based micro-sized bubble generator that can generate a massive amount of micro-sized bubbles with less power by minimizing a load applied to a water supply pump.

(b) Description of the Related Art

A technology that generates micro-sized or nano-sized bubbles (hereinafter referred to as micro-sized bubbles) in water is expected to be utilized in various fields including a water treatment field.

Thus, research and development on a micro-sized bubble generator has been actively pursued. For example, the Korean Patent No. 10-745851 (Jul. 27, 2007) disclosed a bubble generator that generates bubbles of less than several micro meters in size. In Korean Patent 10-745851, a motor performs a pumping operation by a control signal of a controller, water and air having flowed into the motor are discharged to a bubble generator, and the bubble generator discharges air using an air vent to prevent excessive pressure and form bubbles through a bubble discharging module.

Korean Patent Laid-Open Publication No. 10-2010-0030382 (Mar. 18, 2010) disclosed a micro-sized bubble generator that can improve reliability in sanitation by completely discharging residual water in a main pump after completion of operation and directly use tap water.

However, although various technologies for generation of micro-sized bubbles have been developed, technologies for generating massive bubbles of less than a 100 nm size with less power are needed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a micro-sized bubble generator that can increase the generation amount of micro-sized bubbles compared to a use amount of water and air and reduce power consumption.

According to another exemplary embodiment of the present invention, a micro-sized bubble generator that can generate bubbles of less than 100 nm size with low power can be provided.

According to another exemplary embodiment of the present invention, a micro-sized bubble generator that can generate bubbles of less than 50 nm in size with low power can be provided.

A micro-sized bubble generator using a highly-dissolved solution based on a rotating unit according to an exemplary embodiment of the present includes: a rotating unit receiving a mixture of water and gas and discharging a solution while making the water and gas collide with each other and rotating the same; a dissolving tank storing the solution discharged from the rotating unit; and a nozzle unit receiving the solution and generating micro-sized bubbles in the water.

According to the present invention, an apparatus for generating micro-sized bubbles is formed to minimize a load applied to a pump so that a massive amount of microbbubles can be generated with low power.

In addition, the size of the micro-sized bubble that can be massively generated with low power can be less than 100 nm or less than 50 nm. The size of the micro-sized bubble can be less than 20 nm.

DETAILED DESCRIPTION OF THE EMBODIMENTS

Figure 1:
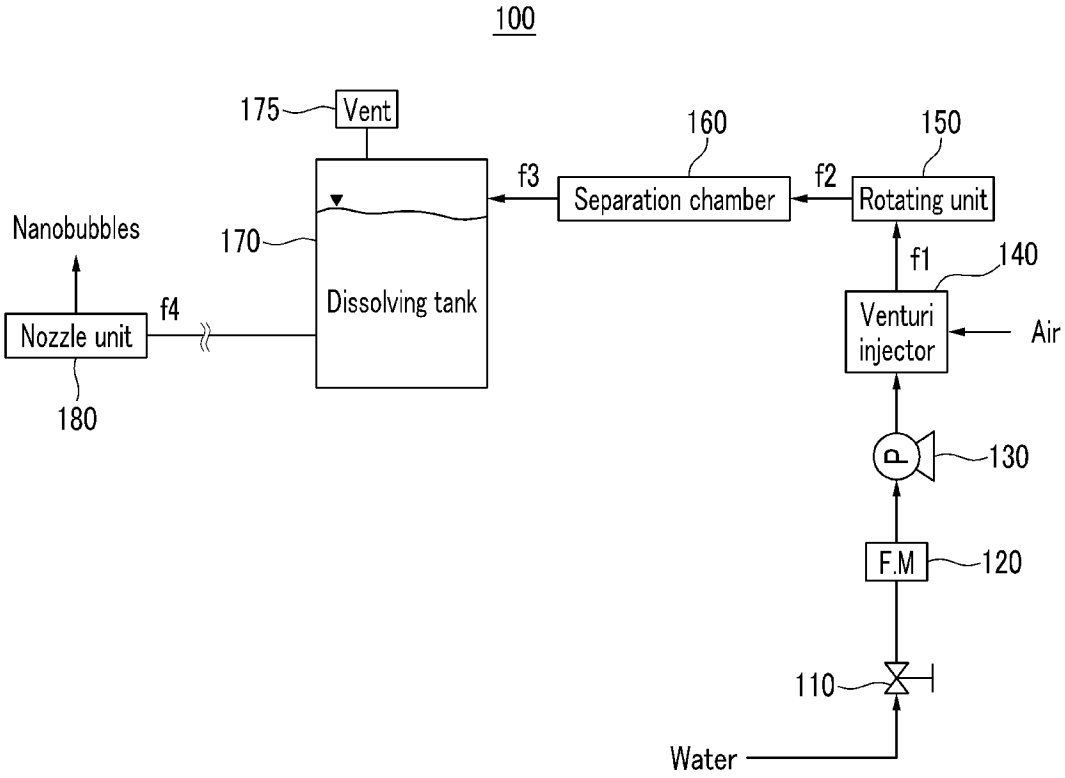
FIG. 1 is a block diagram of a micro-sized bubble generator according to an exemplary embodiment of the present invention.
Figure 2:
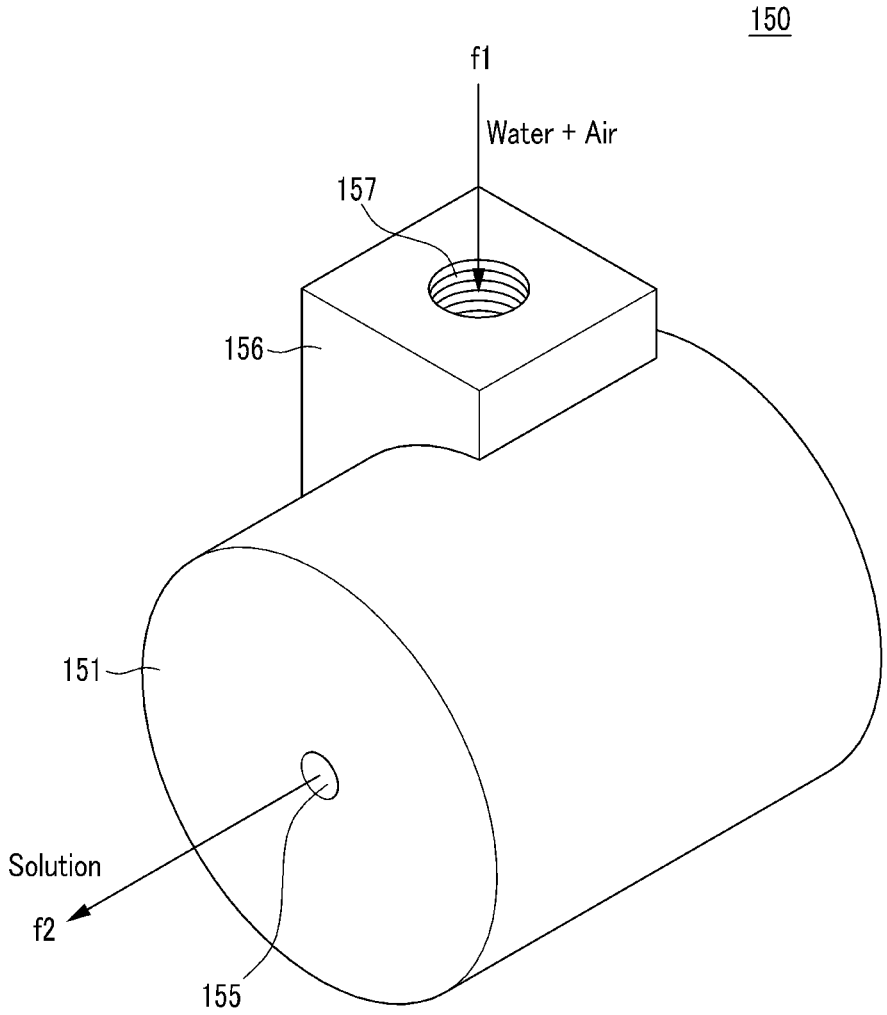
FIG. 2 is a perspective view of a rotating unit of FIG. 1.
Figure 3:
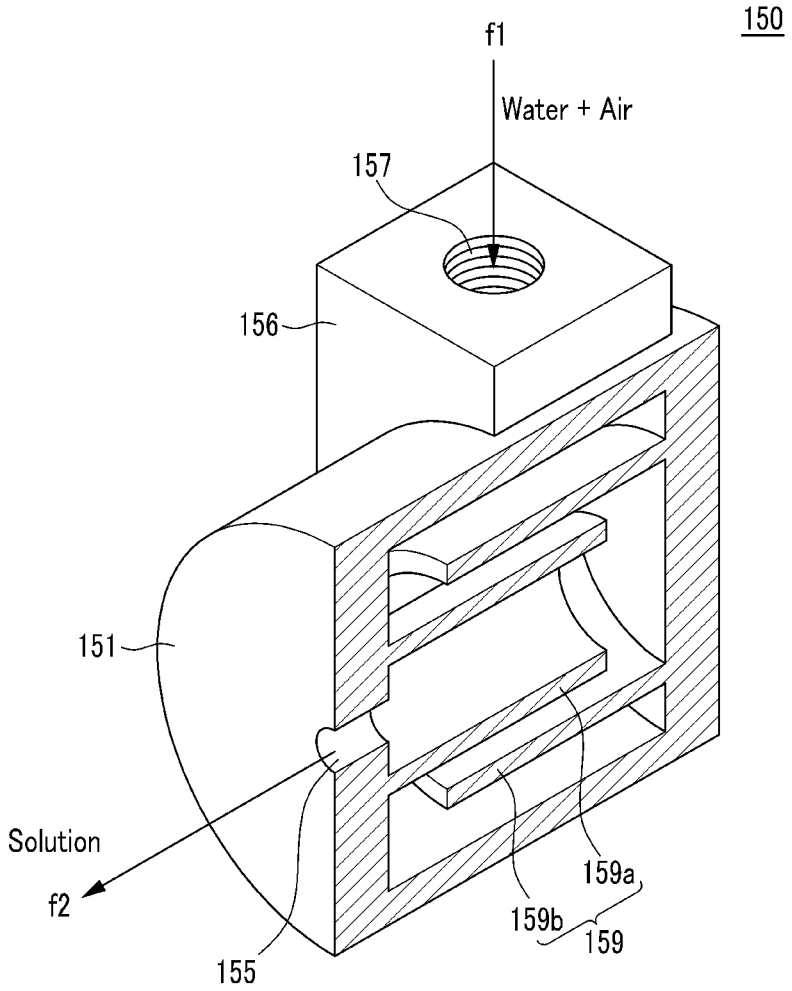
FIG. 3 is a cut-away perspective view of the rotating unit of FIG. 2.
Figure 4:
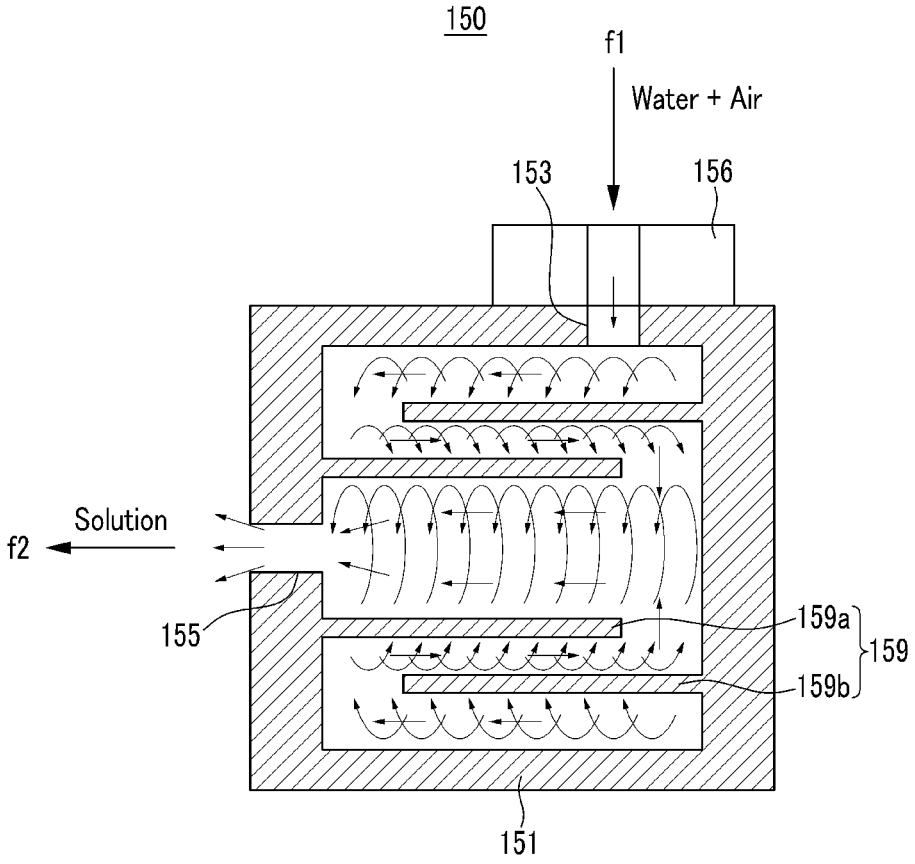
FIG. 4 is a cross-sectional view of the rotating unit of FIG. 2.

The objects, features, and advantageous of the present invention will be described in detail through the following preferable exemplary embodiments with reference to the accompany drawings. As those skilled in the art would realize, the described embodiments may be modified in various different ways, all without departing from the spirit or scope of the present invention. On the contrary, exemplary embodiments introduced herein are provided to make disclosed contents thorough and complete and to sufficiently transfer the spirit of the present invention to those skilled in the art.

It will be understood that when an element such as a layer, film, region, or plate is referred to as being "on" another element, it can be directly on the other element or intervening elements may also be present. In addition, the size and thickness of each component shown in the drawings are arbitrarily shown for understanding and ease of description, but the present invention is not limited thereto.

Exemplary embodiments in the specification will be described with reference to cross-sectional views and/or plan views which are ideal exemplary views of the present invention. In addition, the size and thickness of film and areas shown in the drawings are arbitrarily shown for understanding and ease of description, but the present invention is not limited thereto. Thus, the exemplary views may be modified due to manufacturing methods and/or a permissible error. Therefore, the exemplary embodiments of the present invention are not limited to the shapes shown in the drawings but include variation of the shape depending on a manufacturing process. For example, an etching area illustrated as a right angle may be rounded or have a predetermined curvature. Thus, the areas exemplarily illustrated in the drawings have characteristics, and the shape of the areas shown in the drawings exemplarily illustrates specific shapes, but the present invention is not limited thereto. In the various exemplary embodiments of the specification, the terms, "first", "second", and the like are used to describe various constituent elements, but the constituent elements are not limited to the terms. The terms are used only to distinguish one constituent element from other. The exemplary embodiments described and exemplarily illustrated herein include complementary exemplary embodiments.

Terms used in the specification are provied for description of the exemplary embodiments, and the present invention is not limited thereto. In the specification, singulars in sentencs include plural unless otherwise noted. It will be understood in the specification that the terms "comprises" and "comprising", when used herein, specify the presence of constituent elements, but do not preclude the presence or addition of other constituent elements.

Hereinafter, the present invention will be described in further detail with reference to the accompanying drawings. The following constitutions described in the Examples and the Comparative Examples are provided for better understanding of the present invention. However, a person skilled in the art can recognize that the present invention can be used without description of the contents. Parts that are well known and irrelevant to the present invention will be omitted in description of the present invention to prevent confusion in understanding of the present invention.

FIG. 1 is a detailed block diagram of a micro-sized bubble generator of a rotating unit according to an exemplary embodiment of the present invention.

Referring to FIG. 1, a micro-sized bubble generator 100 of the rotating unit according to the present exemplary embodiment includes a venturi injector 140, a rotating unit 150, a separation chamber 160, a dissolving tank 170, and a nozzle unit 180. For description of the present exemplary embodiment, a valve 110, a flow meter 120, and a water supply pump 130 are additionally illustrated in FIG. 1.

In the micro-sized bubble generator based on the rotating unit according to the present exemplary embodiment, air having entered through the venturi injector 140 and water having entered through the pump 130 are mixed, and the mixture of the air and the water is transmitted to the rotating unit 150 and then rotated. After that, the mixture discharged from the rotating unit 150 is passed through the separation chamber 160 and discharged to the dissolving tank 170.

Through such a series of processes, a highly-dissolved solution containing a large amount of air dissolved therein is generated, and the highly-dissolved solution is sprayed through the nozzle unit 180, thereby generating micro-sized bubbles.

In the specification, the term "mixture" is used to imply one of the following states for description of the present invention.

i) a mixture of water and gas bubbles ii) a mixture of water containing a gas dissolved therein iii) a consolidation of i) and ii)

In addition, for convenience and better understanding in the description, the term "mixture" and the term "solution" will be used without any difference therebetween.

In addition, in exemplary embodiments of the present invention, water and air are mixed, but it is not restrictive. Another gas such as ozone or pure oxygen other than air may be mixed with water. The nozzle unit 180 illustrated in FIG. 7 may have a different shape.

The valve 110 can control the flow amount of water flowing into the water supply pump 130, and the flow meter 120 controls the valve 110 according to the flow amount of water flowing into the water supply pump 130 so that the flow amount of water flowing into the water supply pump 130 can be appropriately controlled.

The water supply pump 130 can supply water flowing through the valve 110 to the venturi injector 140 with a predetermined pressure. According to the exemplary embodiment of the present invention, a massive amount of micro-sized bubbles can be generated while minimizing the pressure of the water supply pump 130.

The venturi injector 140 is formed in the shape of a pipe of which cross-sections of lateral ends are larger than the cross-section of the center thereof, and is a well-known constituent element to a person skilled in the art. In further detail, water flows into one end of the venturi injector 140 and air flows into the center thereof. The air flowing into the center of the venturi injector 140 is discharged to the other end of the venturi injector 140 together with the water. When air enters the venturi injector 140, the air may be partially dissolved into the water.

The rotating unit 150 receives the mixture discharged from the venturi injector 140 and rotates the received mixture. Much more air can be dissolved in the water while passing through the rotating unit 150. The rotating unit 150 according to the exemplary embodiment of the present invention has a structure that can minimize the pressure of the pump 130 while discharging water supplied from the pump 130 to the separation chamber 160.

Referring to FIG. 2 to FIG. 5, the rotating unit 150 according to the exemplary embodiment of the present invention receives a mixture f1 of the water and air discharged from the venturi injector 140, rotates the mixture f1, and discharges a rotated mixture f2 to the separation chamber 160.

The rotating unit 150 according to the exemplary embodiment of the present invention includes a rotating main body 151 and a water/air rotation guiding unit 159 provided in the rotating main body 151.

The rotating main body 151 is a portion for forming an external figure of the rotating unit 150. The rotating main body 151 may be formed of a metallic material, but it is not limited thereto. The rotating main body 151 may be a transparent or semi-transparent plastic injection material or various other materials.

The rotating main body 151 is provided with a water/air inlet 153 for receiving inflow of water and air, the water/air rotation guide 159 for mixing the water and air while rotating the water and air, and a solution outlet 155 for discharging a mixture of water and air.

According to the exemplary embodiment of the present invention, an interior wall of the solution outlet 155 may be formed as a circular cylinder, excluding an interior wall where the solution outlet 155 is formed, and accordingly, the rotating main body 151 has a constant cross-section.

The water/air inlet 153 according to the exemplary embodiment of the present invention is formed along a tangent line direction, and the solution outlet 155 may be formed in one side wall on the length-directional center of the rotating main body 151. As described, the water/air inlet 153 is disposed to receive the mixture of water and air along the same direction in which the water and air are received from the venturi injector 140.

In the water/air inlet 153 area, a water/air connector 156 is provided to supply water and air to the water/air inlet 153. The water/air connector 156 is provided with a screw portion 157, and a pipe disposed between the venturi injector 140 and the rotating unit 150 may be screw-coupled to the screw portion 157. Meanwhile, the screw portion 157 may provide a path between the venturi injector 140 and the rotating unit 150 according to another exemplary embodiment.

The water/air rotation guide 159 guides rotation of water having flowed into the rotating main body 151 through the water/air inlet 153, and controls water and air to collide with each other while rotating the water in a direction that does not cross the direction of inflow water to prevent pressure from being applied to the inflow water. Accordingly, much more air can be dissolved in the water.

The water/air rotation guide 159 is separately manufactured and then coupled to the corresponding location in the rotating main body 151, but the water/air rotation guide 159 may also be realized using an injection molding method. When the injection molding method is used, the water/air rotation guide 159 and the rotating main body 151 may be integrally manufactured.

In the present exemplary embodiment, the water/air inlet 153 is formed along the tangent line direction of the rotating main body 151 to improve rotation speed of the water and air through the water/air rotation guide 159. Accordingly, the water and air having entered through the water/air inlet 153 start to rotate in the rotation water/air rotation guide 159 without any resistance so that the rotation speed of the water/air is increased. As described, the structure of the rotating unit 150 can minimize pressure to the pump 120.

The water/air rotation guide 159 according to the exemplary embodiment of the present invention includes a plurality of water/air guiding walls 159*a* and 159*b* that allow flow of water from the water/air inlet 153 to the solution outlet 155.

The plurality of water/air guiding walls 159*a* and 159*b* in the present exemplary embodiment include a first wall/air guiding wall 159*a* and a second water/air guiding wall 159*b* that is disposed in an external side along a radial direction of the first water/air guiding wall 159*a*. The first water/air guiding wall 159*a* and the second water/air guiding wall 159*b* are formed in the shape of a pipe.

A first end of the first water/air guiding wall 159*a* is fixed to one side inner wall of the rotating main body 151 where the solution outlet 155 is formed while surrounding the area of the solution outlet 155, and a second end of the first water/air guiding wall 159*a* is separately disposed from the other side inner wall disposed opposite to the one wide inner wall of the rotating main body 151 where the solution outlet 155 is formed.

The second water/air guiding wall 159*b* is disposed in an outer side of the radius direction of the first water/air guiding wall 159*a* and forms a gap with the first water/air guiding wall 159*a*, and one end of the second water/air guiding wall 159*b* is fixed to the other inner wall that opposes the one inner wall of the rotating main body 151 where the solution outlet 155 is formed and the other end is disposed at a distance from the one inner wall of the rotating main body 151 where the solution outlet 155 is formed.

With such a configuration, the water and air having flowed into the rotating main body 151 through the water/air inlet 153 strongly rotate while moving between the second water/air guiding wall 159*b* and the interior circumference of the rotating main body 151, between the second water/air guiding wall 159*b* and the first water/air guiding wall 159*a*, and the inside of the second water/air guiding wall 159*b* such that a solution having excellent solubility is generated from collision between the water and the air, and the solution is discharged through the solution outlet 155. As described, a method for maximizing collision of water and air is selected while not interrupting the original flow of the mixture of the water and air so that micro-sized bubbles can be generated while minimizing power consumption of the pump 120.

Referring to FIG. 1 to FIG. 5, the separation chamber 160 collects undissolved air and collects it in a predetermined area.

The separation chamber 160 according to the exemplary embodiment of the present invention connects the solution outlet 155 of the rotating unit 150 to the dissolving tank 170. In the present exemplary embodiment, the separation chamber 160 is formed of a transparent glass material, but the separation chamber 160 may be formed of other materials such as opaque plastic or a metallic material.

Figure 5:
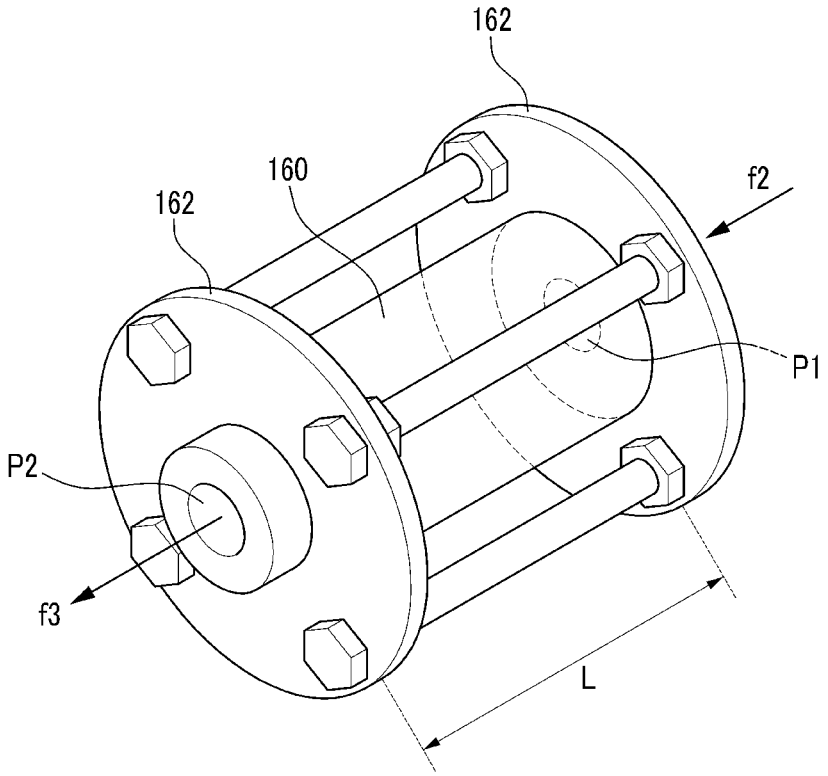
FIG. 5 is a perspective view of the separation chamber in FIG. 1.

Referring to FIG. 5, the separation chamber 160 according to the exemplary embodiment of the present invention is formed in the shape of a hollow cylinder, and is coupled with a pair of substrates 162. The substrates 162 respectively include an opening P1 for receiving the solution and an opening P2 for discharging the solution, and the substrates 162 and the separation chamber 160 are coupled to each other such that the solution flows between the openings P1 and P2 through the separation chamber 160. Here, the opening P1 receiving the solution may be directly coupled to the rotating unit 150 such that the flow of solution can be connected, or the opening P1 may be connected with the rotating unit 150 through a pipe (not shown) or a fastening means (not shown) such as a screw. Such a coupling method is exemplarily stated, and other coupling methods may be used.

Referring to FIG. 5, one of the pair of substrates 162 is directly coupled with the rotating unit 150 or coupled with the rotating unit 150 by an arbitrary means (e.g., a pipe or a fastening means), and the other of the pair of substrates 162 is directly coupled with the dissolving tank 170 or coupled with the dissolving tank 170 by an arbitrary means (e.g., a pipe or a fastening means).

The separation chamber 160 according to the exemplary embodiment of the present invention is formed in the shape of a hollow cylinder, and the center axis of the separation chamber 160 may be disposed along a flow direction of the solution discharged through the solution outlet 155. That is, the length directional center axis of the separation chamber 160 is disposed along the length directional center axis of the rotating main body 151. As shown in FIG. 5, the separation chamber 160 formed in the shape of the hollow cylinder receives the mixture from the rotating unit 150 through one side and discharges the mixture to the dissolving tank 170 through the other side. The separation chamber 160 and the rotating unit 150 can be coupled with each other using any method known to a person in the art. For example, one side (i.e., a portion where the mixture f2 enters in FIG. 5) and the solution outlet 155 of the rotating unit 150 can be directly coupled with each other. Alternatively, the solution outlet 155 and one side of the rotating unit 150 can be coupled with each other using a pipe (not shown).

Meanwhile, the center axis of the separation chamber 160 is matched to the center axis of the rotation unit 150 for maintenance of a rotation force generated in the rotating unit 150, but the present invention is not limited thereto, and the center axes of both may not be completely matched to each other. In addition, the shape of the separation chamber 160 is not limited to the cylinder, and the separation chamber 160 may be formed in other shapes.

The solution f2 discharged from the solution outlet 155 of the rotating unit 150 flows into the separation chamber 160 and thus continues rotating, and undissolved air is separated due to rotation of the solution and collected near the center axis of the separation chamber 160.

Referring to FIG. 5, a length L of the separation chamber 160 corresponds to residence time of the rotating solution, and accordingly, it is preferred that the separation chamber 160 has an optimum length to sufficiently collect undissolved air.

The dissolving tank 170 is a type of storage for storing the solution discharged from the separation chamber 160. In this case, the solution and the undissolved air are discharged together from the separation chamber 160 and moved to an upper portion of the dissolving tank 17 by a buoyant force. In order to discharge the undissolved air to the outside, a vent 175 is provided in the upper portion of the dissolving tank 170.

Figure 6:
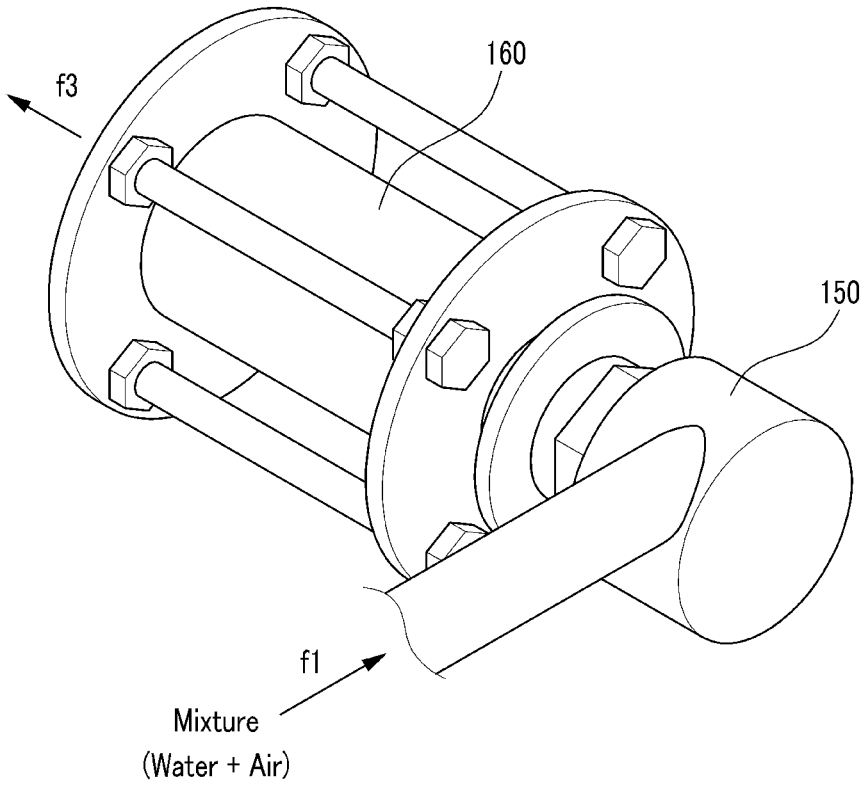
FIG. 6 is provided for description of a coupling relation between the separation chamber and the rotating unit of FIG. 1.

FIG. 6 is provided for description of the separation chamber and the rotating unit of FIG. 1.

FIG. 6 exemplarily shows coupling of the separation chamber 160 and the rotating unit 150. As shown in FIG. 6, the separation chamber 160 and the rotating unit 150 are coupled to each other, and the rotating unit 150 receives the solution discharged from the venturi injector 140 in a tangent line direction. The separation chamber 160 and the rotating unit 150 may be coupled to each other using a fastening means such as a screw, and the separation chamber 160, the opening P1 of the substrate 162, and the solution outlet 155 of the rotating unit 150 are connected with each other in such a manner that the flow of the solution is continued. That is, the solution discharged from the solution outlet 155 is passed through the openings of the substrates 162 and flows into one end of the cylinder-shaped separation chamber 160. After that, the solution having entered into the separation chamber 160 is discharged to the other end of the separation chamber 160 and then moves toward the dissolving tank.

Figure 7:
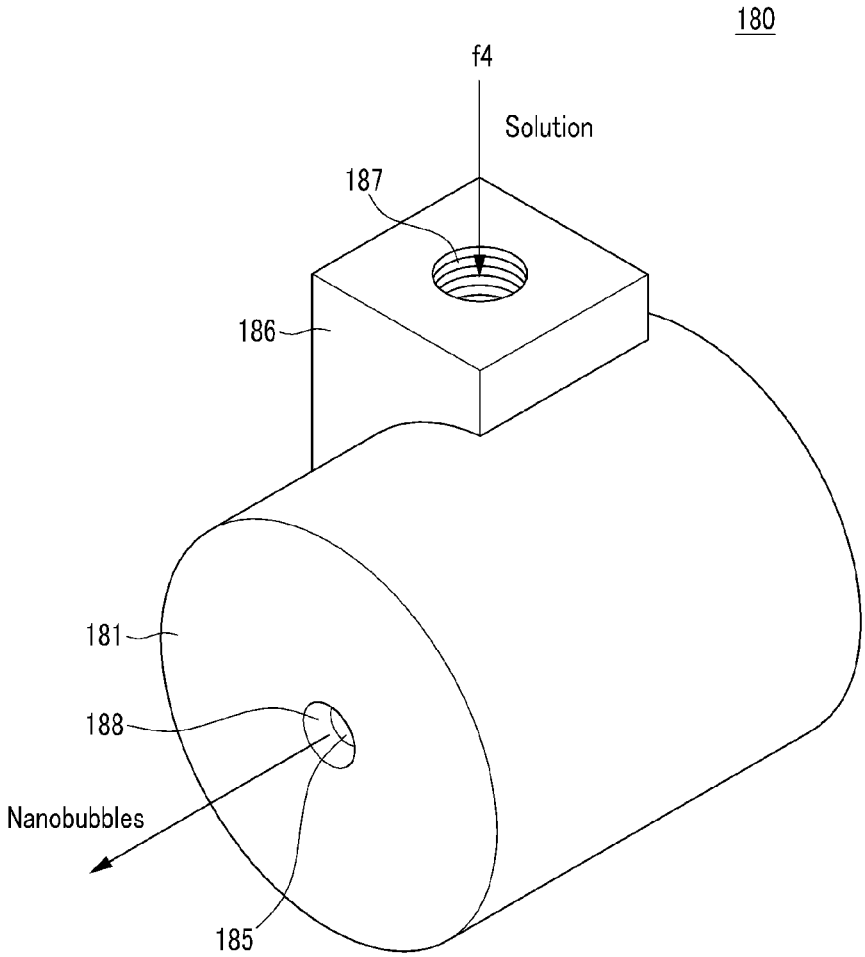
FIG. 7 is a perspective view of the nozzle unit of FIG. 1.
Figure 8:
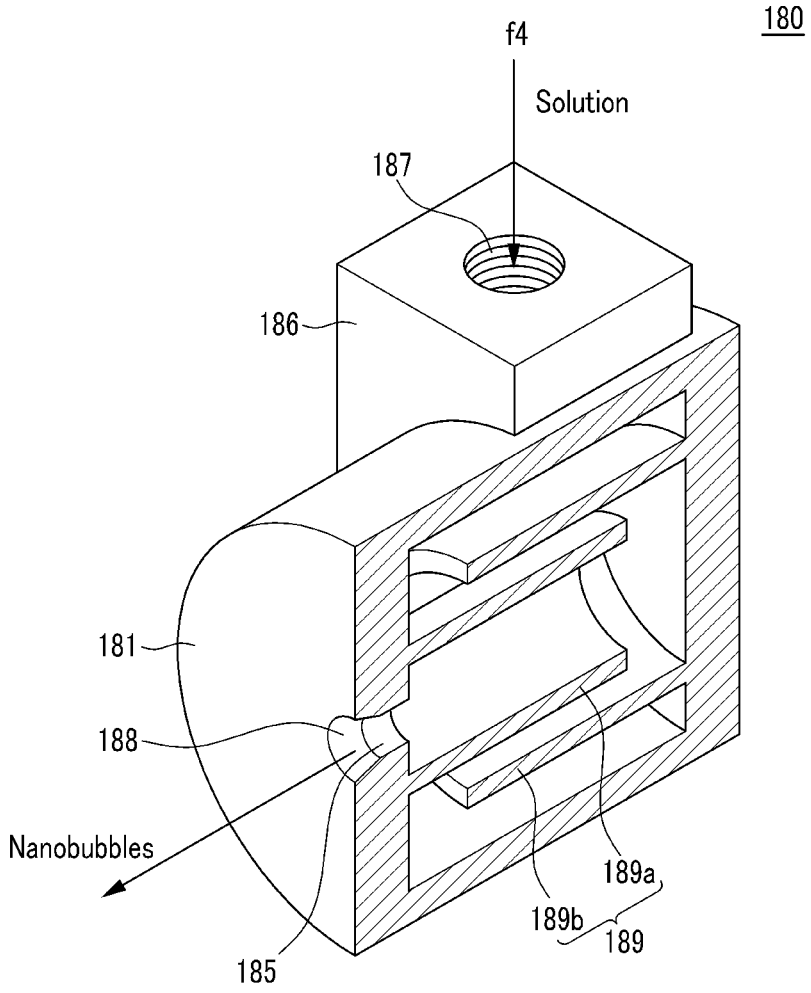
FIG. 8 is a cut-away perspective view of the nozzle unit of FIG. 7.
Figure 9:
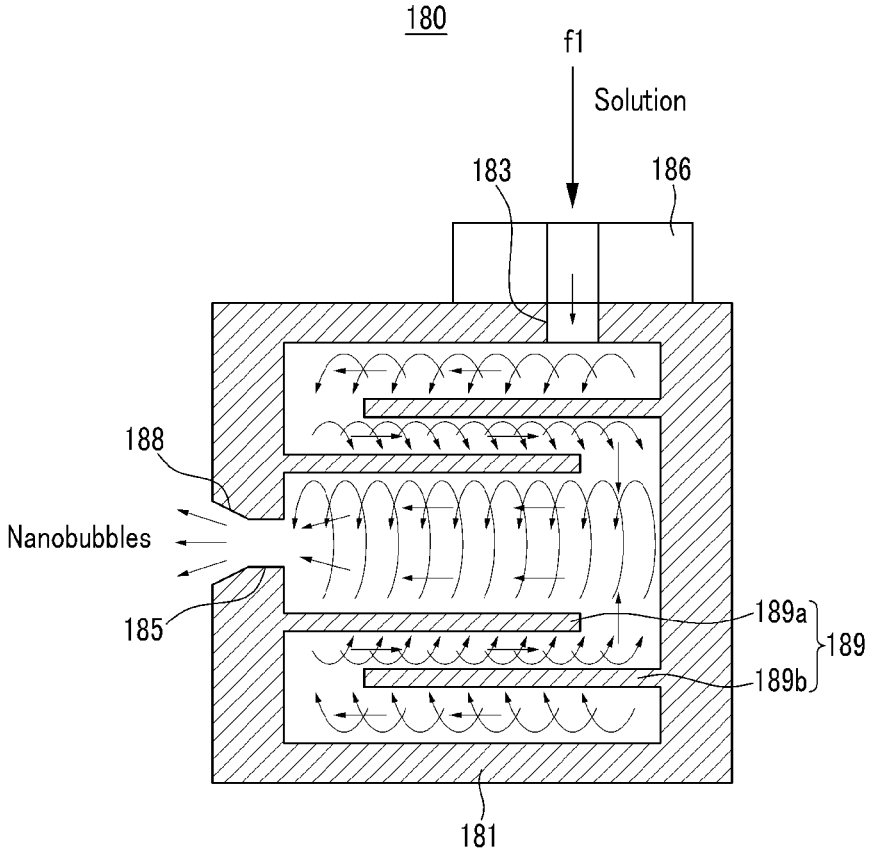
FIG. 9 is a cross-sectional view of the nozzle unit of FIG. 7.

FIG. 7 is a perspective view of the nozzle unit of FIG. 1, FIG. 8 is a cut-away perspective view of the nozzle unit of FIG. 7, and FIG. 9 is a cross-sectional view of the nozzle unit of FIG. 7. Hereinafter, the nozzle unit will be described in further detail with reference to FIG. 7 to FIG. 9.

The nozzle unit 180 is provided in water and receives a solution f4 discharged from the dissolving tank 170, and generates micro-sized bubbles to the water by colliding the solution f4 with the water by discharging the solution f4 to the water at a high speed.

Various nozzle units that can generate micro-sized bubbles by discharging a solution into the water can be used, but the nozzle unit 180 according to the present exemplary embodiment is formed to rotate the solution having flowed from the dissolving tank 170 and discharges the rotating solution into the water to thereby generate micro-sized bubbles. Thus, the solution discharged from the nozzle unit 180 is discharged at a high speed while rotating at a high speed, and accordingly productivity of the micro-sized bubbles can be improved.

Referring to FIG. 5 to FIG. 9, the nozzle unit 180 according to the exemplary embodiment of the present invention may include a nozzle main body 181 and a solution rotation guide 189 provided in the nozzle main body 181.

The nozzle main body 181 forms an exterior appearance of the nozzle unit 180. The nozzle main body 181 may be formed of a metallic material, but this is not restrictive. The nozzle main body 181 may be formed of a transparent or semi-transparent plastic injection material or various other materials.

The nozzle main body 181 is provided with a nozzle inlet 183 into which the solution flows and a nozzle outlet 185 from which the solution is emitted.

In the nozzle unit 180 shown in FIG. 5 to FIG. 9, an extended inclined surface 188 of which a cross-section is gradually increased along a direction to which water is discharged is formed in a part of an inner wall of the nozzle outlet 185. Since the extended inclined surface 188 is formed in the nozzle outlet 185, flow of the solution can be induced faster according to Bernoulli's principle that defines a correlation between a cross-section of fluid and speed, and accordingly productivity of micro-sized bubbles in the water can be improved.

The nozzle unit 180 of FIG. 5 to FIG. 9 is the same as the rotating unit 150 in shape and interior structure, except that the nozzle unit 180 includes the extended inclined surface 188. Thus, a function of the nozzle unit 180 is the same as that of the rotating unit 150, except for the extended inclined surface 188. Meanwhile, the extended inclined surface 188 is formed only in the nozzle unit 180, but it may be formed in rotating units according to another exemplary embodiment.

As described above, the micro-sized bubble generator 100 using the highly-dissolved solution based on the rotating unit of the present invention makes the water and air collide with each other by rotating the water and air to thereby generate a highly-dissolved solution, and then generates micro-sized bubbles by discharging the solution into water such that productivity of micro-sized bubbles compared to the use amount of water and air can be improved.

The rotating unit 150 can maximize the rotation force of the water and air by having the water/air rotation guide 159 formed in the rotating main body 151 so that most of the air supplied therein can be dissolved in the water, thereby generating a highly-dissolved solution.

In addition, the separation chamber 160 is provided between the rotating unit 150 and the dissolving tank 170 to separate undissolved air included in the solution and collect the undissolved air and then discharge the undissolved air to the dissolving tank 170 so that the undissolved air can be quickly emitted from the dissolving tank 170, and accordingly, the high-dissolved solution can be promptly supplied to the nozzle unit 180, thereby improving the production speed of micro-sized bubbles.

In the micro-sized bubble generator 100 using the high-dissolved solution based on the rotating unit of according to the present exemplary embodiment the present invention, the water/air inlet 153 of the rotating unit 150 is formed along the tangent line direction of the rotating main body 151, the rotating main body 151 and the separation chamber 160 are disposed on the same axis, and the nozzle inlet 183 of the nozzle unit 180 is formed along the tangent line direction of the nozzle main body 181 so that the micro-sized bubble generator 100 is in an organized state without experiencing a sudden change in the flow of the fluid, and accordingly a pressure load does not occur in the micro-sized bubble generator 100 and thus a pump 130 having low capacity compared to a conventional case can be used, and compared to a conventional pump, power consumption of the pump 130 can be reduced.

In the above-stated exemplary embodiments, micro-sized bubbles are generated by mixing air and water, but the present invention is not limited thereto. Micro-sized bubbles can be generated not only by mixing air and water but also mixing a gas like oxygen or ozone and water. When the ozone gas and water are mixed, micro-ozone bubbles can be generated. Thus, the present invention may be used to generate micro-sized bubbles by mixing an arbitrary gas and water.

Alternatively, another liquid may be used instead of water according to the present invention. In this case, the present invention may be used to generate micro-sized bubbles by mixing an arbitrary liquid and air.

Further, the present invention may also be used to generate micro-sized bubbles by mixing an arbitrary liquid and an arbitrary gas.

Figure 10:
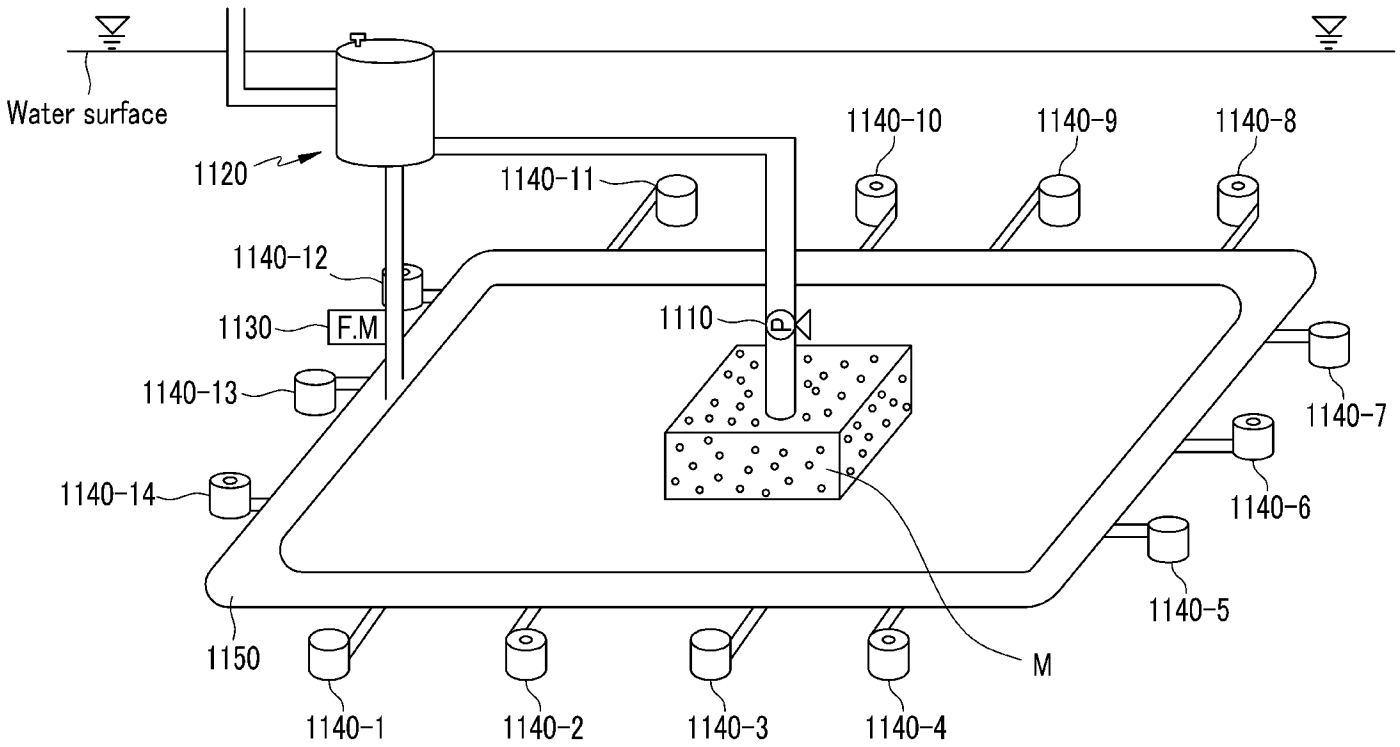
FIG. 10 is a diagram of a micro-sized bubble generator based on a rotating unit according to another exemplary embodiment of the present invention.
Figure 11:
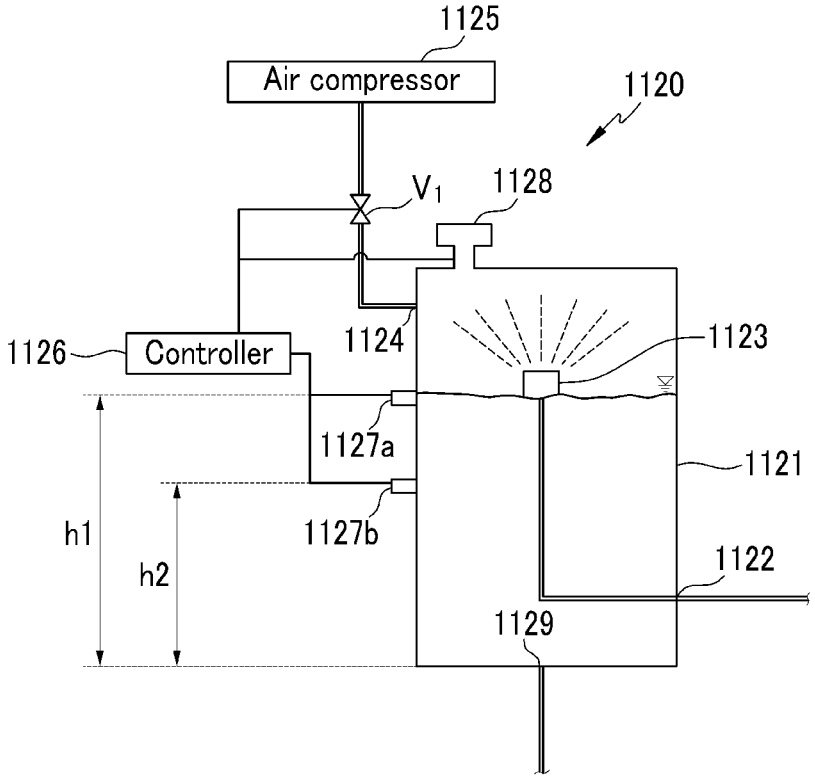
FIG. 11 is a detailed block diagram of an internal configuration of a dissolving tank.

FIG. 10 shows a micro-sized bubble generator based on a rotating unit according to another exemplary embodiment of the present invention, and FIG. 11 is a detailed block diagram of a dissolving tank.

The micro-sized bubble generator according to the present exemplary embodiment of the present invention includes a water supply pump 1110, a dissolving tank 1120, a common pipe 1150 connected with the dissolving tank 1120 for providing a path for movement of water discharged from the dissolving tank 1120, and a plurality of nozzle units 1140-1 to 1140-14. For the purpose of description, a flow meter 1120 is additionally illustrated in FIG. 10.

The micro-sized bubble generator according to the present exemplary embodiment is wholly located in the water and produces a massive amount of micro-sized bubbles and/or nanobubbles.

In the micro-sized bubble generator provided with the dissolving tank according to the present exemplary embodiment, water flows into the dissolving tank 1120 by the pump 1110, the water having flowed into the dissolving tank 1120 is sprayed and thus contacts air, and then the air is dropped so that a high concentration solution (hereinafter, highly-dissolved solution) is received in the dissolving tank 1120. The highly-dissolved solution in the dissolving tank 1120 is sprayed through the plurality of nozzle units 1140-1 to 1140-14 such that micro-sized bubbles can be generated.

As described, air is set to be mixed with water in the present exemplary embodiment, but this is not restrictive. Any gas that can generate micro-sized bubbles may be used, and the gas includes ozone or pure oxygen. Meanwhile, the shape of the plurality of nozzle units 1140-1 to 1140-14 is not limited to the shape shown in FIG. 3. The nozzle units may be formed in another appropriate shape.

The pump 1110 supplies water having flowed therein to the dissolving tank 1120 with a predetermined pressure. According to the present exemplary embodiment, a massive amount of micro-sized bubbles can be generated while minimizing the pressure of the water supply pump 1110.

Meanwhile, as shown in FIG. 10, a porous mesh member M as shown in FIG. 9 may be provided in an inlet side of the pump 1110 to eliminate impurities in the water. Thus, water having flowed in through the pump 1110 does not contain impurities.

The dissolving tank 1120 receives the water discharged from the pump 1110 and sprays the water such that the sprayed water contacts air and a large amount of air is dissolved in the water.

Referring to FIG. 10 and FIG. 11, the dissolving tank 1120 according to the present exemplary embodiment includes a tank main body 1121, a spray nozzle 1123, an air compressor 1125, a controller 1126, first and second level sensors 1127*a* and 1127*b*, and a vent 1128.

Water having flowed into the tank main body 1121 is sprayed through the spray nozzle 1123, and the sprayed water contacts the air supplied to the tank main body 1121 and then is dropped such that highly-dissolved solution is generated and received in the tank main body 1121. A method for spraying water and contacting the water with air is more preferable for generating a highly-dissolved solution than a conventional dissolving method.

In the dissolving tank 1120 according to the present exemplary embodiment, the first and second level sensors 1127*a* and 1127*b* are provided to sense a first level h1 and a second level h2 to maintain a proper water level of the highly-dissolved solution received in the dissolving tank 1120, and, when the water level of the high-dissolved solution received in the tank main body 1121 is sensed by the first and second level sensors 1127*a* and 1127*b*, the controller 1126 controls opening and closing of a valve V1 provided in a connection path between the air compressor 1125 and the dissolving tank 1121 according to a sensing result.

The tank main body 1121 is formed in the shape of a cylinder. The tank main body 1121 may be formed of a metallic material, but this is not restrictive. The tank main body 1121 may be formed of a transparent or semi-transparent plastic injection material or various other materials.

The dissolving tank 1120 is provided with an air inlet 1124, a water inlet 1122 through which water is received from the pump 1110, and a solution outlet 1129 for discharging a solution to a nozzle unit.

The spray nozzle 1123 sprays water having flowed into the tank main body 1121 from the pump 1110 to an upper inner side of the tank main body 1121. The spray nozzle 1123 can be formed with various known structures that can receive water and spray the received water.

The air compressor 1125 is a means for supplying air into the tank main body 1121. The valve V1 is provided on a path that connects the air compressor 1125 and the tank main body 1121. In this case, as an electronic valve, the valve V1 is electrically connected with the controller 1126 to open or block the flow of air supplied to the tank main body 1121 from the air compressor 1125 by a control signal of the controller 1126.

The first level sensor 1127*a* and the second level sensor 1127*b* are electrically connected with the controller 1126 to sense the height (i.e., level) of the highly-dissolved solution received in the tank main body 1121. In the present exemplary embodiment, an ultrasonic wave type of sensor is used, but an optical sensor or various other sensors may be used to sense the level.

The first level sensor 1127*a* senses whether the height of the solution in the tank main body 1121 is h1, and the second level sensor 1127*b* senses whether the height of the solution in the tank main body 1121 is h2 that is lower than h1. In the present exemplary embodiment, the height h1 may be substantially the same as a location of a lower end of the spray nozzle 1123.

When the first level sensor 1127*a* senses that the level of the water is the height h1, the controller 1126 according to the present exemplary embodiment opens the valve V1 to supply air into the tank main body 1121. Accordingly, an air pressure in the tank main body 1121 is increased and thus the solution received in the tank main body 1121 is pressurized and the level of the highly-dissolved solution becomes lower than the first height h1.

In addition, when the second level sensor 1127*b* senses that the level of the water is the height h2, the controller 1126 stops supplying the air into the tank main body 1121.

By the control of the controller 1126, the level of the high-dissolved solution received in the tank main body 1121 is maintained between the first height h1 and the second height h2 so that the highly-dissolved solution can be efficiently generated in the tank main body 1121 and a sufficient amount of highly-dissolved solution to be supplied to the plurality of nozzle units 1140-1 to 1140-14 can be acquired.

That is, the level of the highly-dissolved solution is maintained to be lower than the spray nozzle 1123 to thereby prevent water having flowed into the tank main body 1121 from being mixed with the highly-dissolved solution instead of being sprayed. In addition, the level of the highly-dissolved solution is prevented from being lower than the height h2 to acquire the minimum amount of highly-dissolved solution to be supplied to the plurality of nozzle units 1140-1 to 1140-14.

Meanwhile, the vent 1128 is provided in an upper portion of the tank main body 1121 to discharge air to the outside so as to control air pressure in the tank main body 1121. The vent 1128 according to the present exemplary embodiment can be electronically opened and closed, and is electrically connected with the controller 1126.

In this case, the controller 1126 opens the vent 1128 to discharge air from the tank main body 1121 to promptly reduce the air pressure in the tank main body 1121 when the second level sensor 1127*b* senses that the level of the water is the height h2.

When the level of the solution in the tank main body 1121 is lower than the height h2, the high pressure in the tank main body 1121 is promptly reduced to increase the level of the solution to be higher than the height h2.

As described, the dissolving tank 1120 according to the present exemplary embodiment sprays water having flowed from the pump 1110, and the sprayed water contacts air so that productivity of the highly-dissolved solution can be improved.

In addition, the dissolving tank 1120 controls air supply into the tank main body 1121 using the first and second level sensors 1127*a* and 1127*b* and the controller 1126 to maintain the level of the highly-dissolved solution with a constant height so that productivity of the highly-dissolved solution can be improved and a sufficient amount of highly-dissolved solution to be supplied to the plurality of nozzle units 1140-1 to 1140-14 can be acquired.

The flow meter 1130 measures the flow amount of the highly-dissolved solution having flowed into the plurality of nozzle units 1140-1 to 1140-140 from the dissolving tank 1120.

The plurality of nozzle units 1140-1 to 1140-14 receive the highly-dissolved solution received in the tank main body 1121 and discharge the highly-dissolved solution into the water at a high speed for collision of the highly-dissolved solution against the water to generate micro-sized bubbles in the water.

The plurality of nozzle units 1140-1 to 1140-14 according to the present invention receive the high-dissolved solution and discharge the highly-dissolved solution to the water to generate micro-sized bubbles, but the nozzle units according to the present exemplary embodiment are formed to rotate the highly-dissolved solution having flowed from the tank main body 1121 and discharge the highly-dissolved solution into the water for generation of micro-sized bubbles. Thus, the highly-dissolved solution discharged from the nozzle units 1140-1 to 1140-14 is discharged while rotating at a high speed so that productivity of the micro-sized bubbles can be improved.

The plurality of nozzle units 1140-1 to 1140-14 performing the above-stated function may respectively have the same structure, but this is not restrictive. They may have different configurations, respectively.

For example, the nozzle units shown in FIG. 7 may be used as the plurality of nozzles 1140-1 to 1140-14. Alternatively, one of nozzle units shown in FIG. 14 to FIG. 21 may be used as at least one of the nozzle units 1140-1 to 1140-14.

Alternatively, the plurality of nozzle units 1140-1 to 1140-14 according to the present exemplary embodiment may be arranged in a manner such that nozzle outlets 1145 of neighboring nozzle units are disposed opposite to each other. That is, as shown in FIG. 10, nozzle outlets 1145 of odd-numbered nozzle units 1140-1, 1140-3, 1140-5, . . . are disposed toward a lower portion direction, and nozzle outlets 1145 of even-numbered nozzle units 1140-2, 1140-4, 1140-6, . . . are disposed toward an upper portion direction. Thus, micro-sized bubbles can be promptly generated in water of a large area through the plurality of nozzle units 1140-1 to 1140-14.

Figure 12:
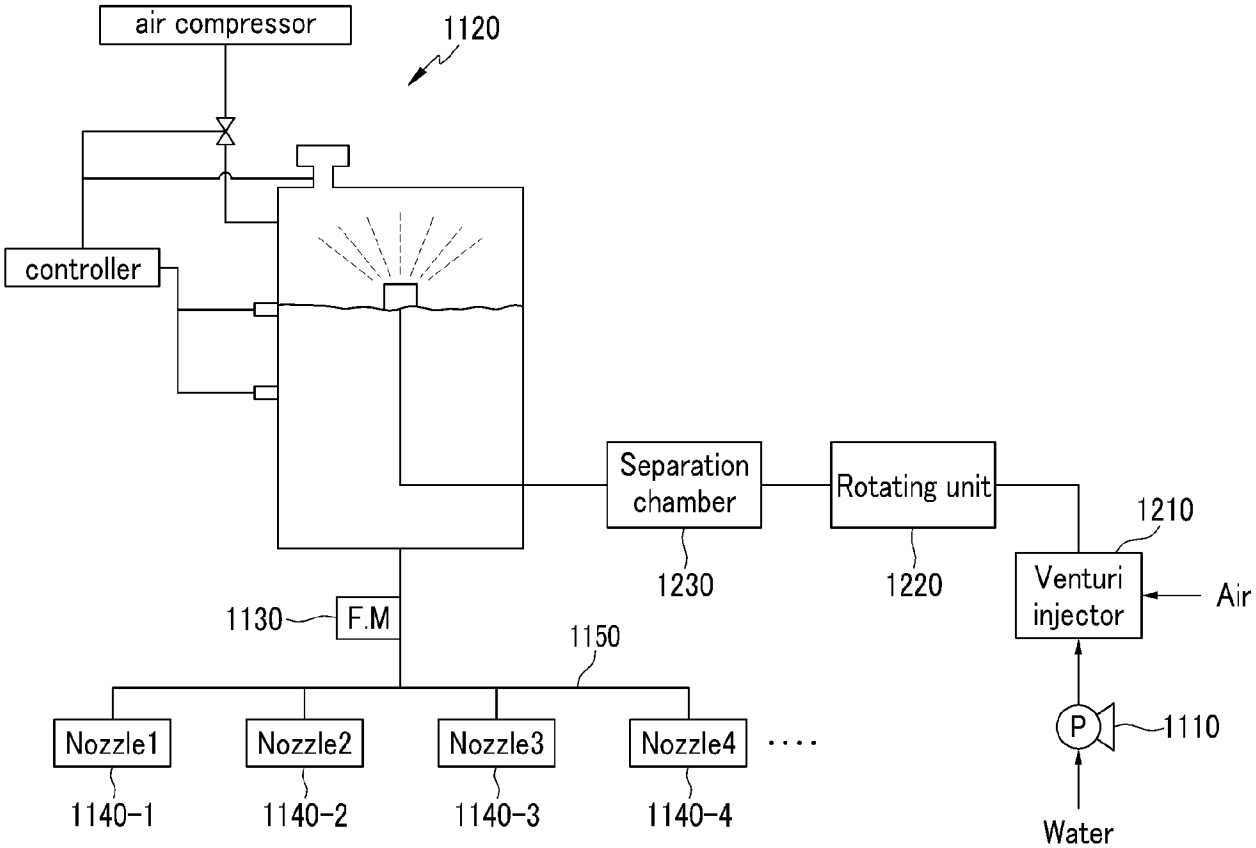
FIG. 12 is provided for description of the exemplary embodiment of FIG. 10.

A micro-sized bubble generator including the dissolving tank according to the exemplary embodiment of FIG. 10 will now be descried with reference to FIG. 12. FIG. 12 illustrates a configuration of a path that connects the dissolving tank 1120 and the pump 1110 in further detail.

Referring to FIG. 12, a venturi injector 1210, a rotating unit 1220, and a separation chamber 1230 are provided on the path that connects the dissolving tank 1120 and the pump 1110.

According to the present exemplary embodiment, water supplied from a pump P is mixed with water having flowed in through the venturi injector 1210, and a mixture of the water and air is supplied to the rotating unit 1220 and rotates therein, thereby generating a solution. The solution discharged from the rotating unit 1220 is the same as that of the previously described exemplary embodiment, except that the solution is supplied to the dissolving tank 1120 through the separation chamber 1230, and therefore the solution will not be further described.

The venturi injector 1210 is formed in the shape of a pipe of which a cross-section of each of lateral ends is larger than a cross-section of the center thereof, and is a constituent element that is well known to a person skilled in the art. In further detail, water flows into one end of the venturi injector 1210 and air flows into the center thereof. The air having flowed into the center of the venturi injector 1210 is discharged through the other end of the injector 1210 together with the inflow water. When the air flows in through the venturi injector 1210, the air may be partially dissolved in the water.

The rotating unit 1220 receives the mixture discharged from the venturi injector 1210 and rotates the mixture. A large amount of air is dissolved in the water while passing through the rotating unit 1220. The rotating unit 1220 according to the exemplary embodiment of the present invention has a structure in which the water supplied from the pump 1110 is discharged toward the separation chamber 1230 while minimizing pressure of the pump 1110.

Figure 13:
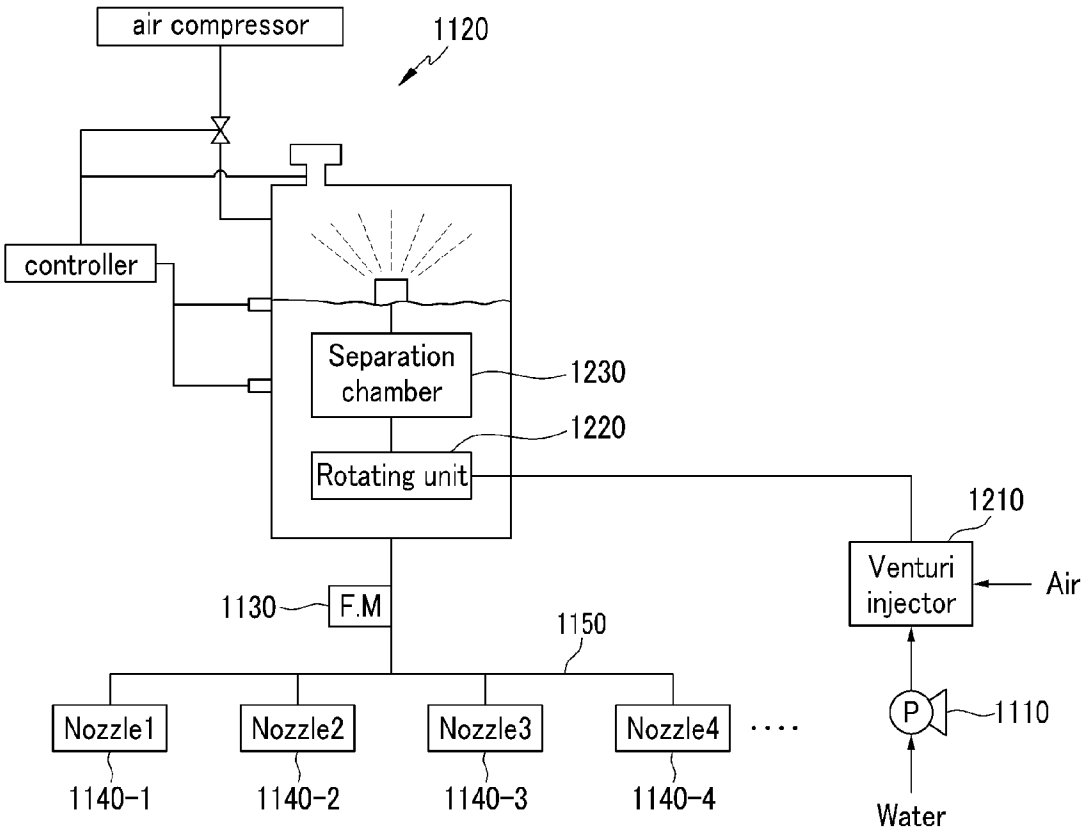
FIG. 13 is a function block diagram of a micro-sized bubble generator provided with a dissolving tank according to another exemplary embodiment of the present invention.

FIG. 13 is a function block diagram of a micro-sized bubble generator including a dissolving tank according to another exemplary embodiment of the present invention. Referring to FIG. 13, the present exemplary embodiment is the same as the exemplary embodiment of FIG. 10, except that a separation chamber 1230 and a rotating unit 1220 are sunk in a solution received in a tank main body 1121. Thus, a detailed description of the exemplary embodiment of FIG. 13 is the same as that of the exemplary embodiment of FIG. 10 to FIG. 12.

Figure 14:
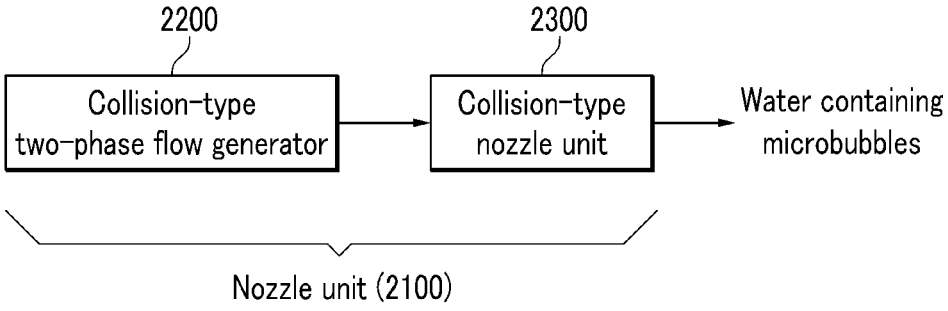
FIG. 14 is a function block diagram of a nozzle unit using movable balls according to an exemplary embodiment of the present invention.
Figure 15:
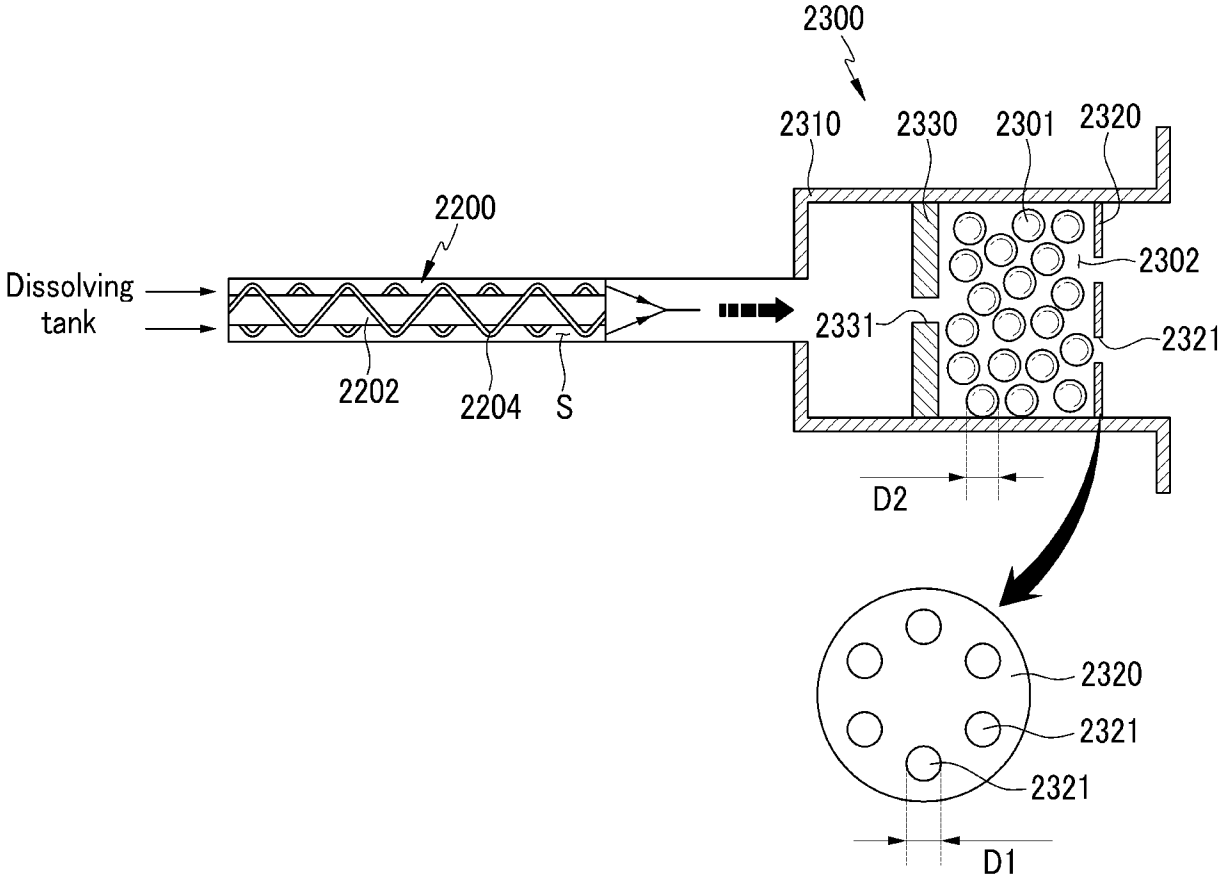
FIG. 15 is a schematic structure diagram of the nozzle unit using the movable balls of FIG. 14.
Figure 16:
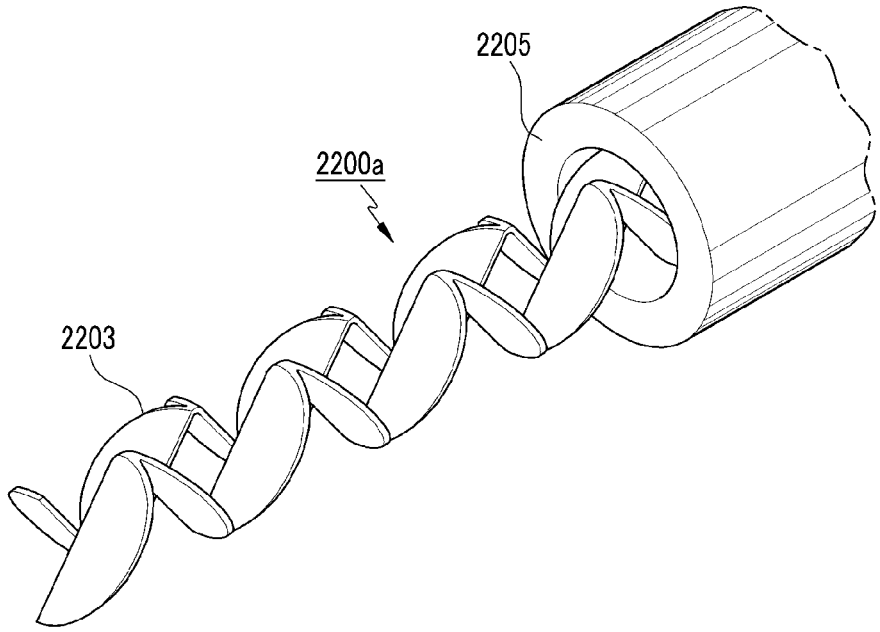
FIG. 16 and FIG. 17 are exemplary variations of a collision-type two-phase flow generator applied to FIG. 14.
Figure 17:
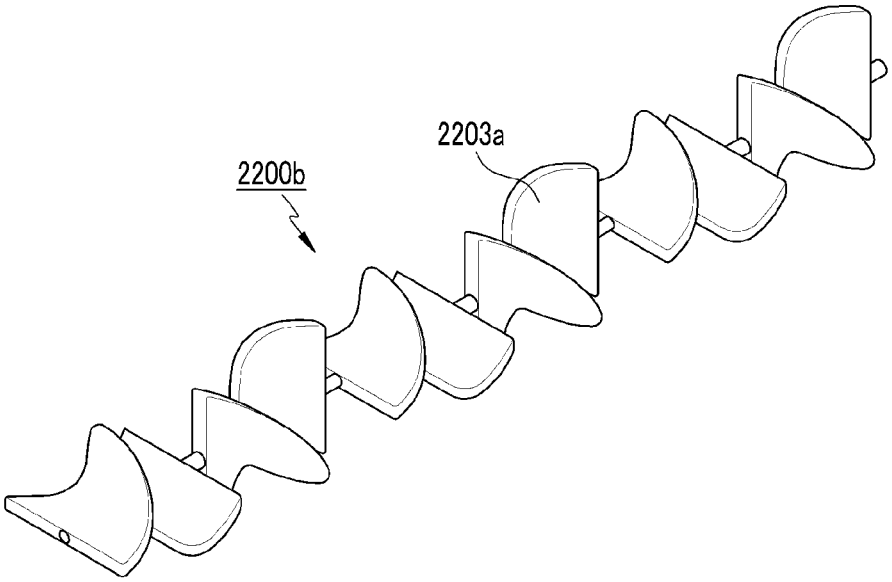

FIG. 14 is a function block diagram of a nozzle unit using movable balls according to an exemplary embodiment of the present invention, FIG. 15 is a schematic structure view of the nozzle unit of FIG. 14, and FIG. 16 and FIG. 17 are exemplary variations of a collision-type two-phase flow generator applied to FIG. 14.

Figure 24:
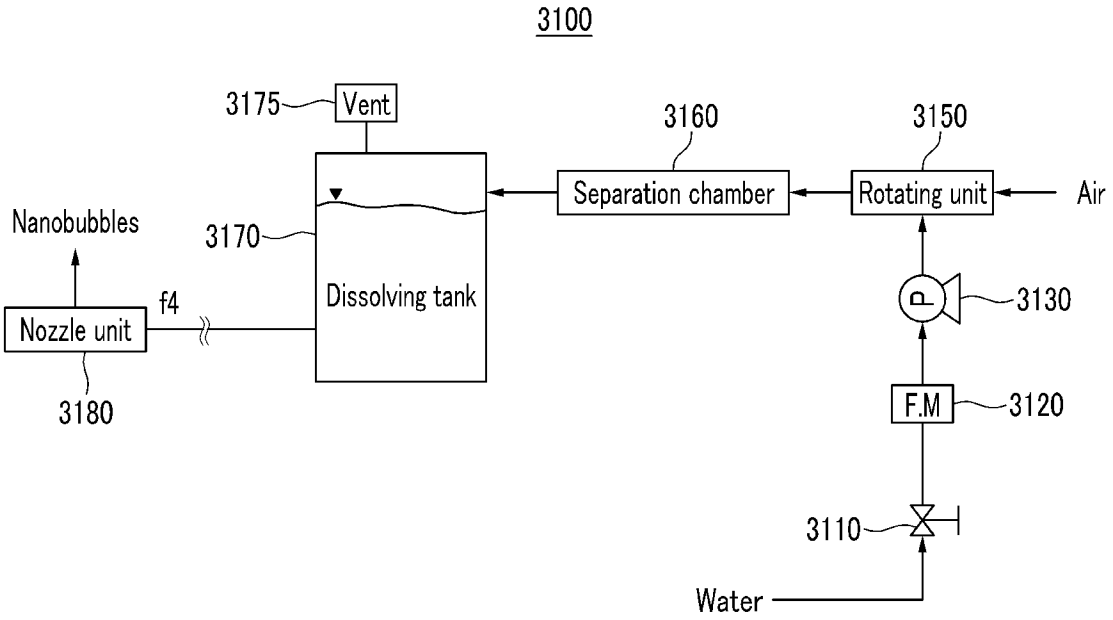
FIG. 24 is a detailed block diagram of a micro-sized bubble generator based on a rotating unit according to another exemplary embodiment of the present invention.

Referring to the drawings, a nozzle unit 2100 using movable balls according to the present exemplary embodiment includes a collision-type two-phase flow generator 2200 and a collision-type nozzle unit 2300, and the nozzle units 180 of the exemplary embodiment of FIG. 1, the nozzle units 1140-1 to 1140-14 of the exemplary embodiment of FIG. 10, and nozzle units 3180 of an exemplary embodiment of FIG. 24 may be used as the nozzle units of the present exemplary embodiment.

Referring to FIG. 14, the collision-type two-phase flow generator 2200 causes water (here, a gas is partially mixed into the water) discharged from a water/gas outlet of an injector to collide with a gas to mix the water and gas while colliding with each other.

The collision-type two-phase flow generator 2200 includes a vein support 2202 and a vein 2204. The vein support 2202 is formed in the shape of a bar having closed ends, and the vein 2204 is fixed in a spiral manner to the external surface of the vein support 2202.

In this case, the shape, width, and size of the vein 2204 are not restrictive. The vein 2204 may have any shape, width, and size that can make water and gas strongly collide with each other and apply pressure to the two-phase flows.

However, as in the present exemplary embodiment, when the vein 2204 is formed in the shape of a spiral, a collision area of the water and gas passing through the area is increased so that the water and gas can be further effectively mixed.

Since the vein support 2202 is formed in the shape of a pipe having closed ends, a mixture of water and gas discharged from the water/gas outlet of the injector passes only through a space S between the external surface of the vein support 2202 and an inner side of the collision-type two-phase flow generator 2200, that is, a space where the vein 2204 is disposed. Then, the water and the gas continuously collide with each other while bumping into the vein 2204 and then mixed with each other such that two-phase flow is generated.

An exemplary variation of collision-type two-phase flow generators 2200*a* and 2200*b* will be described with reference to FIG. 16 and FIG. 17.

Referring to FIG. 16, the collision-type two-phase flow generator 2200*a* includes a vein 2203 and a cover 2205 surrounding the vein 2203. Like the vein 2204 of FIG. 15, the vein 2203 makes water and gas strongly collide with each other and, at the same time, applies pressure to the two-phase flow. The vein 2203 is formed in the shape of an extended twist. As previously described, the shape, width, and size of the vein 2204 are not restrictive as long as the vein can make water and gas strongly collide with each other. The vein 2203 occupies a given amount of space in the collision-type two-phase flow generator 2200*a* so that water and gas are iteratively collided with each other, separated from each other, and mixed with each other as the flow speed is increased.

Referring to FIG. 17, the collision-type two-phase flow generator 2200*b* is provided with a vein 2203*a* formed in the shape of serially arranged vanes. However, such a structure of the collision-type two-phase flow generator 2200*b* does not cause any problem in the effect of the present invention.

Thus, any variation other than the shapes and structures of FIG. 15 to FIG. 17 can be variously applied as long as the two-phase flows are smoothly collided with each other, separated from each other, and then mixed with each other and pressure applied to the two-phase flows is increased, thereby increasing flow speed.

Meanwhile, the collision-type nozzle unit 2300 causes the two-phase flow that is a mixture of gas and water mixed by the collision-type two-phase flow generator 2200 to collide with each other again to generate micro-sized bubbles.

As shown in FIG. 15, the collision-type nozzle unit 2300 connected to a rear end of the collision-type two-phase flow generator 2200 in a two-phase flow flow direction is provided with a plurality of balls 2301 generating micro-sized bubbles from collision with the two-phase flow, a nozzle body 2310 coupled to the collision-type two-phase flow generator 2200 and including a ball receiving space 2302 formed therein to receive the plurality of balls 2301 to be flowable, and ball guides 2320 and 2330 provided in the nozzle body 2310 to prevent the balls 2301 from deviating while transmitting the two-phase flow.

In the present exemplary embodiment, unlike the conventional case, the plurality of balls 2301 are used to increase the number of collisions with the two-phase flow, thereby increasing the generation amount of micro-sized bubbles. Particularly, since the plurality of balls 2301 collide with the two-phase flow while moving in the ball receiving space 2302 rather than being fixed, the number of collisions with the two-phase flow is further increased, thereby increasing the amount of micro-sized bubbles.

Further, since the plurality of balls 2301 collide with the two-phase flow while moving in the ball receiving space 2302, an occurrence of a clog in the nozzle body 2310 can be minimized.

According to experiments, the balls 2301 are charged in a range between 70% to 90% of the ball receiving space 2302 and, further particularly, about 80% of the ball receiving space, so as to be movable in the ball receiving space 2302 between the front and rear ball guides 2330 and 2320. Thus, the number of collisions with the two-phase flow or collision range can be increased while enabling the balls 2301 to freely move. However, the scope of the present invention is not limited to the percentage.

The balls 2301 provided in the ball receiving space 2302 should not be corroded by foreign particles in the two-phase flow during a process for generating the micro-sized bubbles from collision. In order to prevent this, the balls 2301 of the present exemplary embodiment receive a surface treatment so as to prevent deposition of foreign particles or contaminants to the surfaces of the balls 2301. For example, titanium dioxide or an antimicrobial agent may be coated to the surfaces of the balls 2301 to prevent corrosion, wherein the titanium dioxide or antimicrobial agent provides an antimicrobial function to the two-phase flow. Thus, the balls 2301 of the present exemplary embodiment are functional balls.

The nozzle body 2310 forms an external appearance of the collision-type nozzle unit 2300. The nozzle body 2310 may be formed in the shape of a pipe, but this is not restrictive. That is, the collision-type nozzle unit 2300 may be formed in any shape and connected to the rear end of the collision-type two-phase flow generator 2200.

The ball guides 2320 and 2330 are provided with the rear-end ball guide 2320 connected to the nozzle body 2310 at the rear end of the balls 2301 along the flow direction of the two-phase flow, and the front-end ball guide 2330 disposed opposite the rear-end ball guide 2320, interposing the balls 2301 therebetween.

As shown in FIG. 15, the rear-end ball guide 2320 is formed substantially in the shape of a disk, and a plurality of rear end holes 2321 are formed in the plate surface of the rear-end ball guide 2320.

The rear end holes 2321 are portions through which the micro-sized bubbles and the two-phase flow are passed, and a diameter D1 of each rear end hole 2321 is smaller than a diameter D2 of the ball 2301 such that the balls 2301 can be prevented from deviating from the ball receiving space 2302. The diameter D1 of the rear end hole 2321 may be 50% to 70% of the diameter D2, and further particularly, the diameter D1 is approximately 60% of the diameter D2, but the scope of the present invention is not limited to the percentages.

Next, the front-end ball guide 2330 is a portion disposed opposite to the rear-end ball guide 2320, interposing the balls 2301 therebetween to prevent deviation of the balls 2301 from their positions, and a front end hole 2331 is formed in the plate surface of the front end ball guide 2330 to transmit the two-phase flow. In the drawing, one front end hole 2331 and six rear end holes 2321 are illustrated, but the present invention is not limited thereto. The front-end ball guide 2330 may be individually manufactured and then coupled to the nozzle body 2310, or may be integrally formed with the nozzle body 2310.

An operation of the nozzle unit having the above-described configuration will be described. The nozzle unit is applied to the exemplary embodiment of FIG. 1.

A mixture f4 of water and air discharged from the dissolving tank 170 flows into the collision-type two-phase flow generator 2200 of the nozzle unit. The nozzle unit and the dissolving tank 170 may be connected using a pipe (not shown) and the like, but the present invention is not limited thereto.

In the collision-type two-phase flow generator 2200, the inflow water (gas is partially mixed into the water) and air are primarily mixed with each other by colliding with each other, in order words, by colliding the mixed water and air.

The mixture flows only through a space S between the outer surface of the vein support 2202 and the inner surface of the collision-type two-phase flow generator 2200, that is, a space where the vein 2204 is provided. While being passed, the mixture bumps into the vein 2204 such that the water and the gas strongly collide with each other, thereby generating the two-phase flow.

Meanwhile, the two-phase flow generated by the collision-type two-phase flow generator 2200 is passed through the collision-type nozzle unit 2300. First, the two-phase flow having passed through the front end hole 2331 of the front-end ball guide 2330 collides against the plurality of balls 2301 moving in the ball receiving space 2302, and since the balls 2301 move, a number of collisions and the collision direction and area are increased so that a massive number of micro-sized bubbles are generated. The micro-sized bubbles are discharged through the rear end holes 2321 of the rear-end ball guide 2320 together with the rest of the two-phase flow.

When the nozzle unit of the present exemplary embodiment is used, occurrence of a clog in the collision-type nozzle unit 2300 can be prevented and a much greater amount of micro-sized bubbles can be generated per unit hour.

Hereinafter, an exemplary variation of collision-type nozzle units 2300*a*-2300*e* will be described with reference to FIG. 18 to FIG. 22, and like reference numerals designate like elements throughout the exemplary variations and repeated descriptions will be omitted.

FIG. 18 to FIG. 22 show schematic structures of nozzle units using fluid balls of the second to sixth exemplary embodiments of the present invention. The nozzle units shown in FIG. 18 to FIG. 22 can also be used as the nozzle units 180 of the exemplary embodiment shown in FIG. 1, the nozzle units 1140-1 to 1140-14 of the exemplary embodiment shown in FIG. 10, or nozzle units 3180 of an exemplary embodiment shown in FIG. 24.

Figure 18:
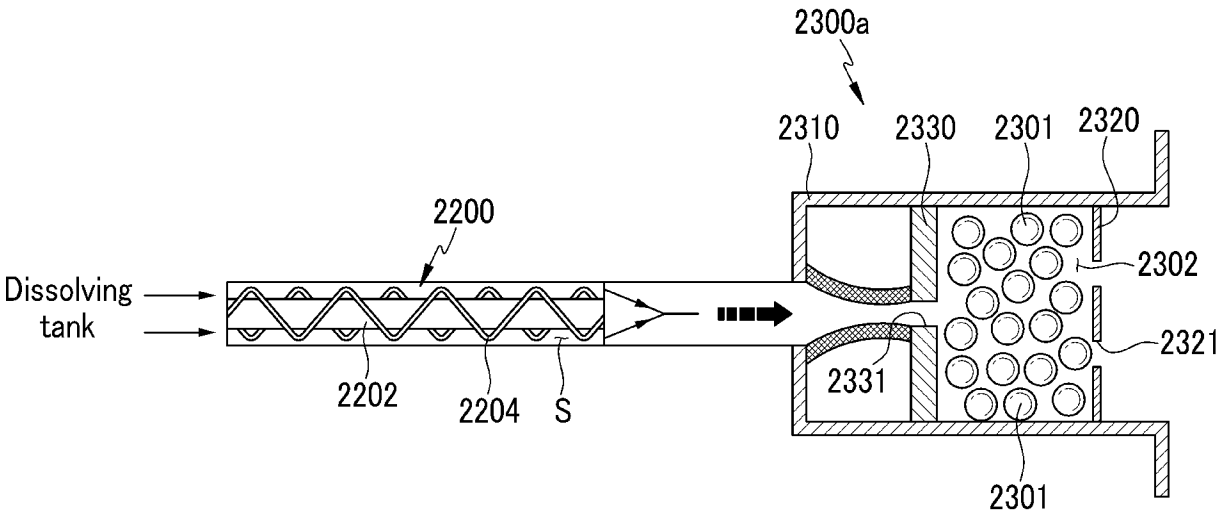
FIG. 18 to FIG. 22 are schematic structure diagram of a nozzle unit using movable balls according to second to sixth exemplary embodiments.

Referring to FIG. 18, the collision-type nozzle unit 2300*a* of the nozzle unit according to the second exemplary embodiment of the present invention further includes guiding plates 2340 guiding the two-phase flow toward a front-end ball guide 2330 further provided in a side wall of the nozzle body 2310 that contacts the collision-type two-phase flow generator 2200 and the front-end ball guide 2330. In this case, the guiding plate 2340 may be formed in the shape of a curved line to easily guide the two-phase flow toward the front-end ball guide 2330.

Figure 19:
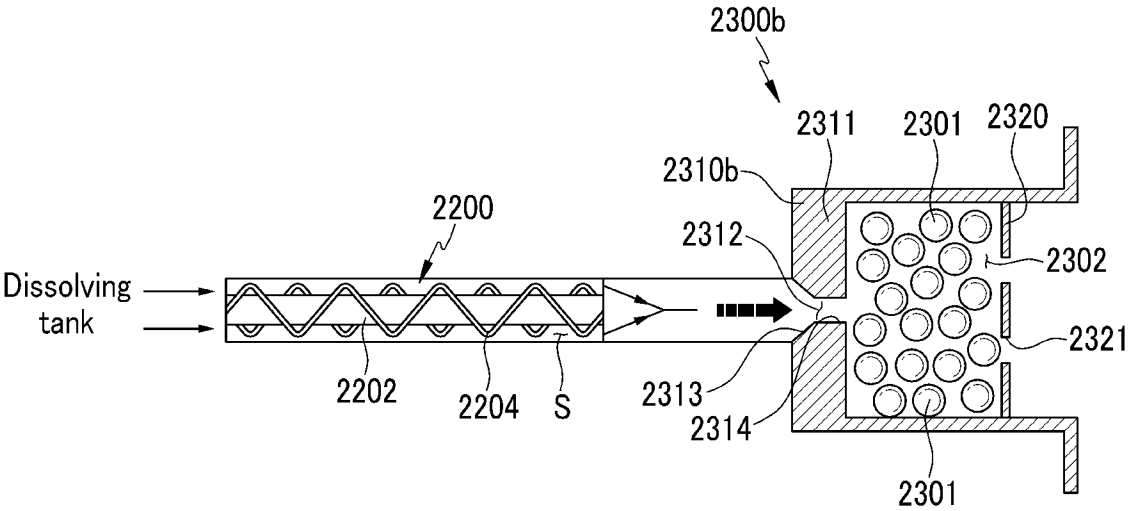

Referring to FIG. 19, in the case of a collision-type nozzle unit 2300*b* of the nozzle unit according to the third exemplary embodiment of the present invention, a front-end ball guide 2311 is not individually provided like the previously-stated exemplary embodiments, but is formed by one side wall 2311 of a nozzle body 2310*b*.

In this case, a front-end hole 2312 is formed in the front-end ball guide 2311 that is the one side wall 2311 of the nozzle body 2310*b*, and the front-end hole 2312 is provided with a axial diameter section 2313 that is more narrowly inclined than the exterior diameter of the collision-type two-phase flow generator 2200 and an extension section 2314 extended toward a plurality of balls 2301 from the axial diameter section 2313.

Figure 20:
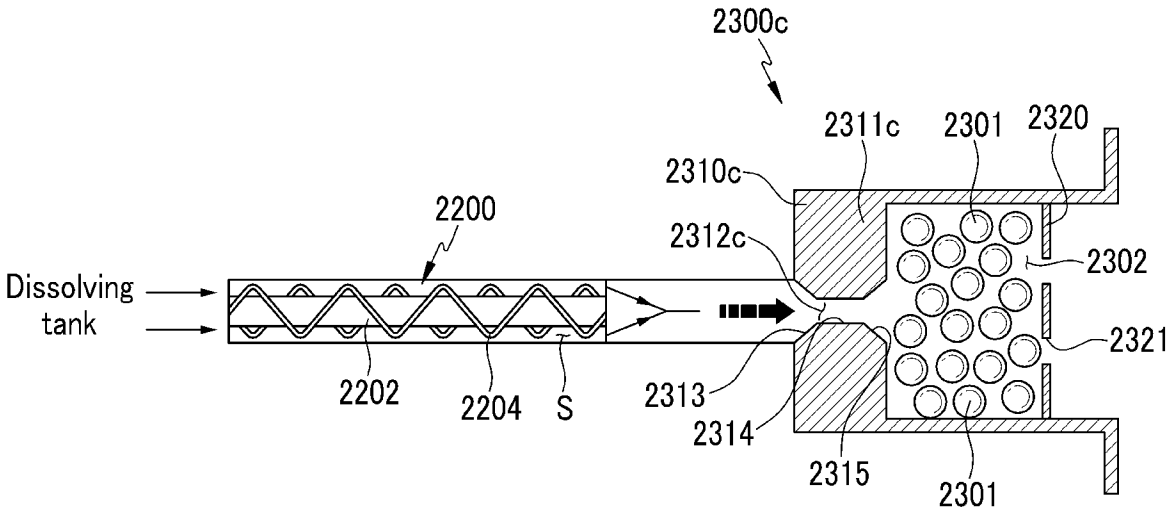

Referring to FIG. 20, in a collision-type nozzle unit 2300*c* of a nozzle unit according to a fourth exemplary embodiment of the present invention, a ball guide 2311*c* is not individually formed like the above-stated exemplary embodiments but is formed by one side wall 2311*c* of a nozzle body 2310*c*.

A front-end hole 2312*c* formed in the front-end ball guide 2311*c* further includes an expansion section 2315 gradually extended toward a plurality of balls 2301 from an extension section 2314 in addition to the axial diameter section 2313 and the extension section 2314 of the previous exemplary embodiment. In this case, the flow speed of the two-phase flow is increased and thus many more micro-sized bubbles can be generated.

Figure 21:
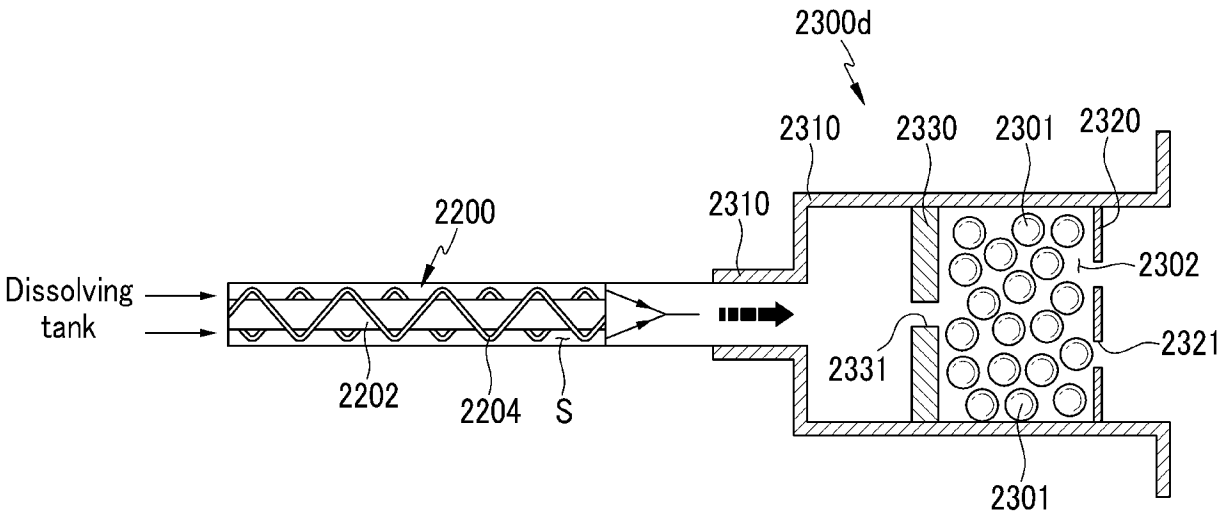

Referring to FIG. 21, a collision-type nozzle unit 2300*d* of a nozzle unit according to a fifth exemplary embodiment of the present invention is the same as that of the first exemplary embodiment, except that a coupling boss 2360 provided in one side of the nozzle body 2310 and detachable from the exterior surface of the collision-type two-phase flow generator 2200 is further provided. The coupling boss 2360 may be a screw-type boss or a pressure-type boss, and when the coupling boss 2360 is provided, replacement or maintenance of the collision-type nozzle unit 2300*d* can be conveniently performed.

Figure 22:
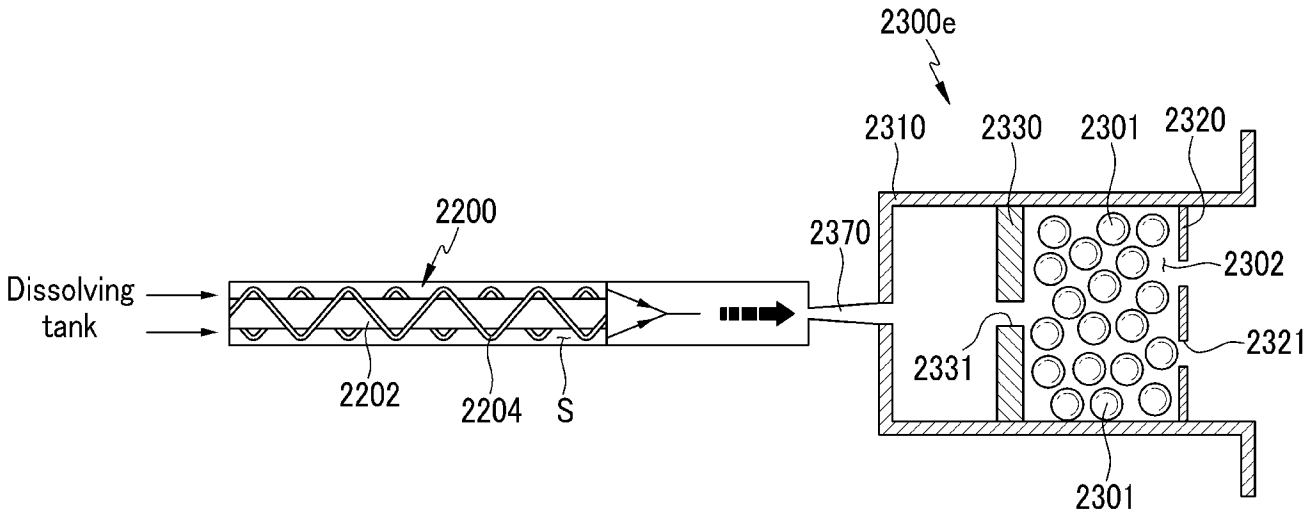

Referring to FIG. 22, a collision-type nozzle unit 2300*e* of a nozzle unit according to a sixth exemplary embodiment of the present invention is the same as that of the first exemplary embodiment, except that a connection line 2370 is further provided between a collision-type two-phase flow generator 2200 and the collision-type nozzle unit 2300*e* for connection therebetween.

A diameter of the connection line 2370 may be gradually increased toward the collision-type nozzle unit 2300*e* from the collision-type two-phase flow generator 2200, and in this case, many more micro-sized bubbles can be generated due to an increase of fluid speed of the two-phase flow.

Figure 23:
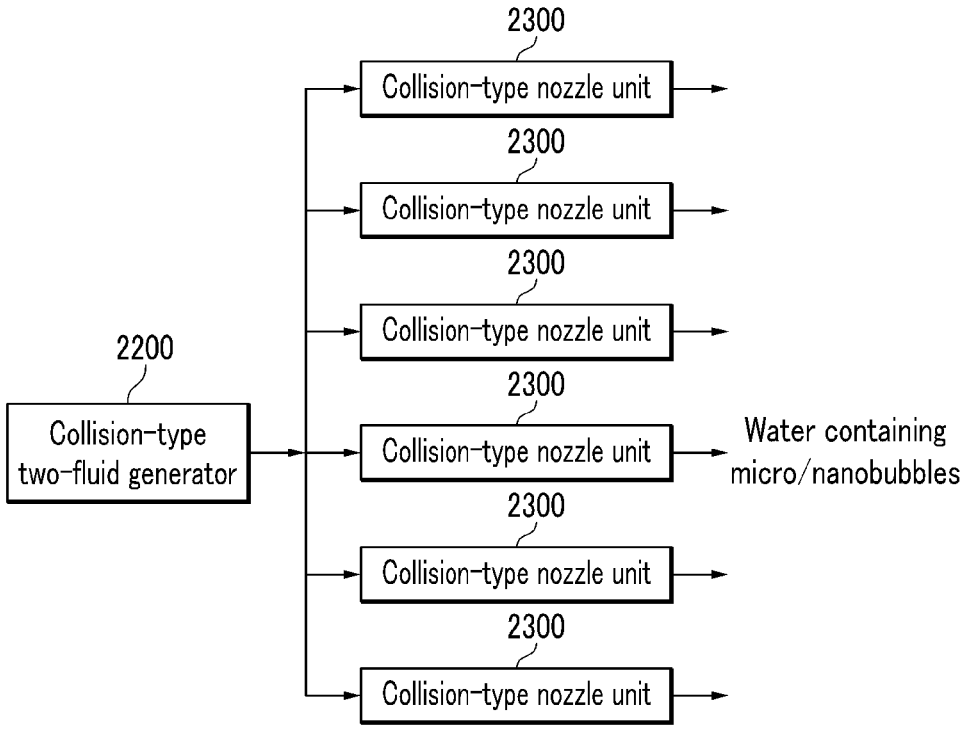
FIG. 23 is a function block diagram of a nozzle unit according to a seventh exemplary embodiment of the present invention.

FIG. 23 is a function block diagram of a nozzle unit according to a seventh exemplary embodiment of the present invention.

Referring to FIG. 23, a nozzle unit according to the seventh exemplary embodiment of the present invention includes a collision-type two-phase flow generator 2200 and a plurality of collision-type nozzle units 2300, and may be used as the nozzle units 180 of the exemplary embodiment shown in FIG. 1, the nozzle units 1140-1 1140-14 of the exemplary embodiment of FIG. 10, and nozzle units 3180 of an exemplary embodiment shown in FIG. 24.

A function of each of the collision-type two-phase flow generator 2200 and the collision-type nozzle unit 2300 shown in FIG. 23 is the same as the function described with reference to FIG. 14 and FIG. 15, and therefore no further description will be provided.

However, the collision-type two-phase flow generator 2200 shown in FIG. 23 is connected with the plurality of collision-type nozzle units 2300 in parallel or series, and therefore water containing many more micro-sized bubbles than the previously described exemplary embodiments can be generated.

According to the above-described exemplary embodiments of the present invention, nozzle clog in the collision-type nozzle units 2300*a* to 2300*e* can be improved and many more micro-sized bubbles can be generated per unit time.

FIG. 24 is a detailed block diagram of a micro-sized bubble generator based on a rotating unit according to another exemplary embodiment of the present invention.

Referring to FIG. 24, a micro-sized bubble generator 3100 according to the present exemplary embodiment includes a rotating unit 3150, a separation chamber 3160, a dissolving tank 3170, and a nozzle unit 3180. For the purpose of description, a valve 3110, a flow meter 3120, and a water supply pump 3130 are further illustrated in FIG. 24.

In the micro-sized bubble generator based on the rotating unit according to the present exemplary embodiment, water and air are respectively supplied from different inlets and the water and the air are supplied to the rotating unit 3150 and then rotated. After that, a mixture of the water and air discharged from the rotating unit 3150 is discharged to the dissolving tank 3170 through the separation chamber 3160. Through such a series of operations, a highly-dissolved solution containing much more air dissolved therein is generated in the dissolving tank 3170, and the highly-dissolved solution is sprayed through the nozzle unit 3180 such that micro-sized bubbles can be generated.

According to an exemplary embodiment of the present invention, any one of rotating units shown in FIG. 25 to FIG. 46 may be used as the rotating unit of FIG. 24. In addition, the separation chamber shown in FIG. 5 may be used as the separation chamber 3160 of FIG. 24. Any one of the nozzle units shown in FIG. 7 and FIG. 14 to FIG. 23 may be used as the nozzle unit 3180 of FIG. 24. Further, a configuration of the dissolving tank of FIG. 24 may be the same as that of the dissolving tank of FIG. 11, but the configuration of the dissolving tank shown in FIG. 24 is not limited to the configuration of the dissolving tank shown in FIG. 11.

The exemplary embodiment of FIG. 24 is different from the exemplary embodiment shown in FIG. 1 in that the rotating unit 3150 of FIG. 24 and the rotating unit 150 of FIG. 1 respectively have different configurations, and the rotating unit 3150 will now be described in further detail with reference to rotating units of FIG. 25 to FIG. 46. Meanwhile, an injector is not illustrated in FIG. 24, but the injector is a selective constituent element and thus will be used as necessary. For example, if an injector is used between the rotating unit 3150 and the pump 3130, air is injected not only through the rotating unit 3150 but also through the injector.

Figure 25:
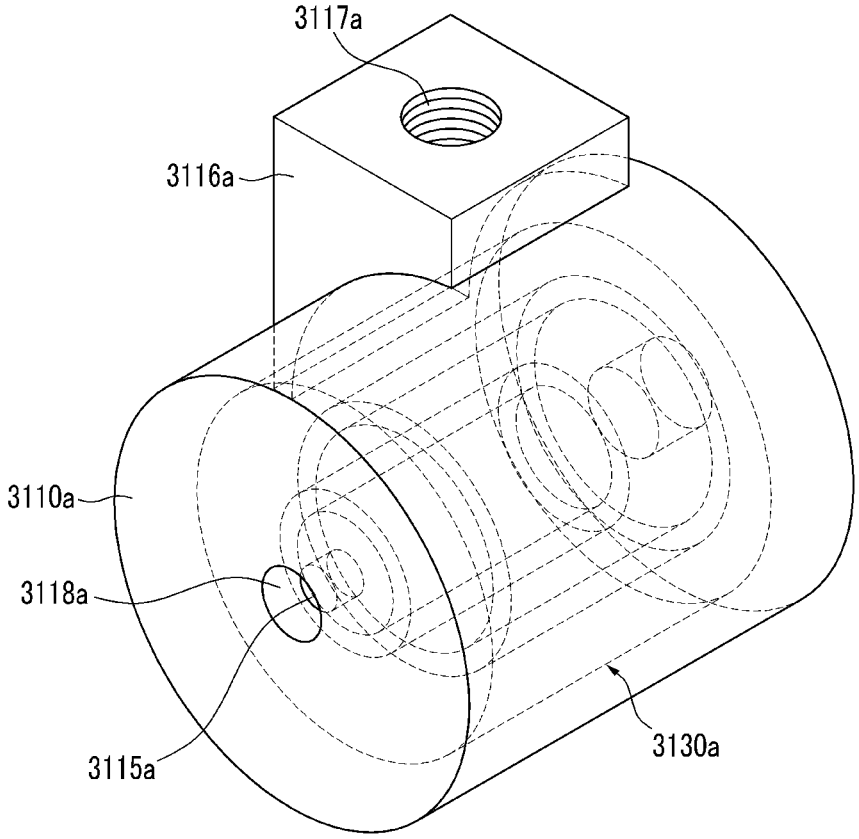
FIG. 25 is a projection perspective view of the rotating unit according to the exemplary embodiment of the present invention.
Figure 26:
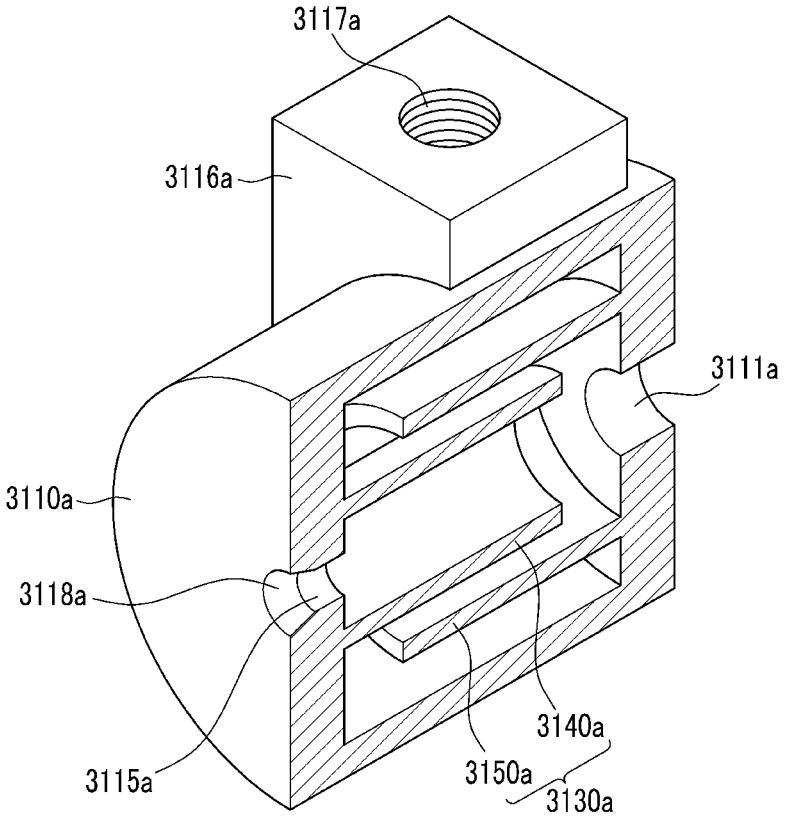
FIG. 26 and FIG. 27 are cut-away perspective views of the rotating unit of FIG. 25 from other angles.
Figure 27:
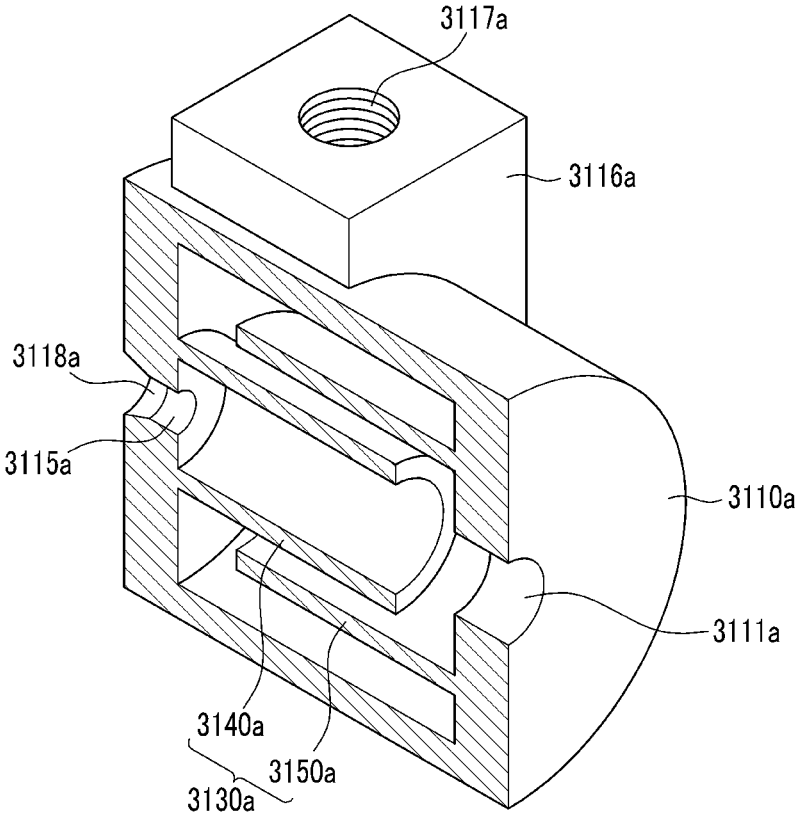
Figure 28:
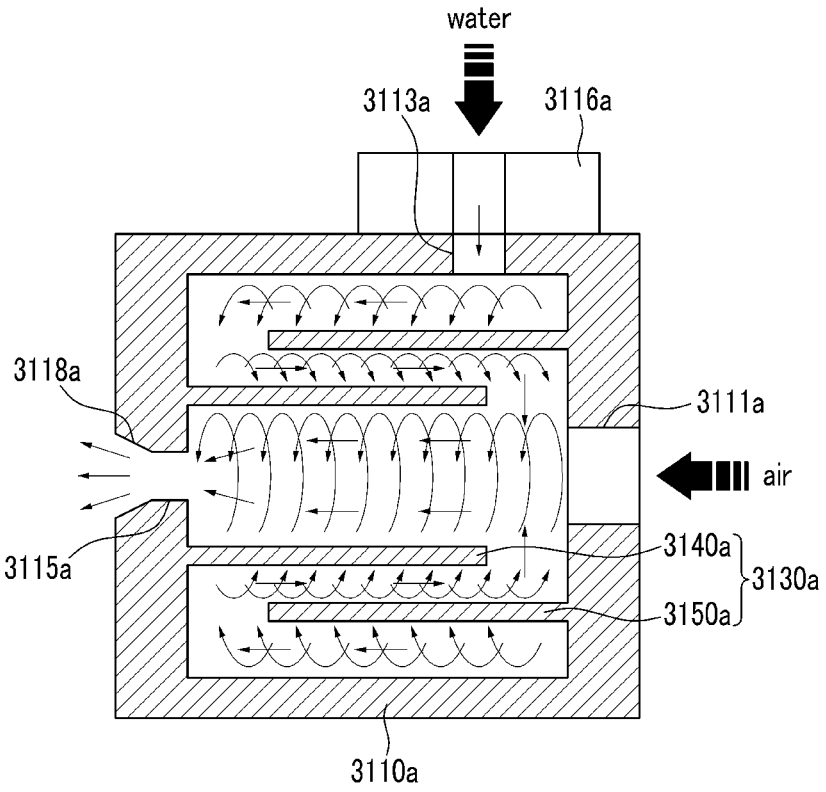
FIG. 28 is a cross-sectional view of FIG. 25.

FIG. 25 is an internal projection perspective view of the rotating unit according to a first exemplary embodiment of the present invention, FIG. 26 and FIG. 27 are cut-away perspective views of FIG. 25, cut away at different angles, and FIG. 28 is a cross-sectional view of FIG. 25.

As shown in the drawings, the rotating unit of the present exemplary embodiment is a device for generating micro-sized bubbles with a diameter of less than several micrometers, for example, less than 50 micrometers, and includes a device main body 3110*a* and a rotation guide 3130*a* provided in the device main body 3110*a*.

The device main body 3110*a* is a portion forming an exterior appearance of the rotating unit of the present exemplary embodiment. The device main body 3110*a* may be formed of a transparent or semi-transparent plastic injection material, but it is not limited thereto.

The device main body 3110*a* is provided with an air inlet 3111*a* through which air flows in, a water inlet 3113*a* through which water flows in at a different location, and a water outlet 3115*a* through which water where micro-sized bubbles are generated by interaction between the air and the water is discharged.

The device main body 3110*a* may be formed in the shape of a circular cylinder of which an inner wall, excluding a portion where the air inlet 3111*a* and the water outlet 3115*a* are formed, has a consistent cross-section. In case of such a structure, the air inlet 3111*a* and the water outlet 3115*a* may be disposed opposite to each other at lateral ends of the device main body 3110*a*, as shown in FIG. 27.

Since the air inlet 3111*a* and the water outlet 3115*a* are disposed to be opposite to each other at lateral ends of the device main body 3110*a*, a series of processes for generating micro-sized bubbles by colliding the inflow air and discharging the micro-sized bubbles can be organically performed, but it is not restrictive. That is, the locations of the air inlet 3111*a*, the water outlet 3115*a*, and the water inlet 3113*a* may be changed as necessary.

Referring to the drawings of the present exemplary embodiment, the air inlet 3111*a* is formed in the shape of a hole, but this is not restrictive. Like the water inlet 3113*a*, an additional connector (not shown) may be provided in the air inlet 3111*a*. That is, the water inlet 3113*a* is provided with a water supply connector 3116*a* for supplying water to the water inlet 3113*a*. A screw 3117*a* is formed in the water supply connector 3116*a*.

An expansion inclined surface 3118*a* that is gradually expanded along a direction in which the water is discharged is formed in a part of the inner wall of the water outlet 3115*a*. Since the expansion inclined surface 3118*a* is formed in the water outlet 3115*a*, flow of the solution can be induced to be faster according to Bernoulli's principle that defines a correlation between a cross-section of fluid and speed, and accordingly productivity of micro-sized bubbles in the water can be improved.

The rotation guide 3130*a* induces rotation of water having flowed into the device main body 3110*a* through the water inlet 3113*a* and guides the water toward air taken in through the air inlet 3111*a* while strongly rotating the water.

The rotation guide 3130*a* may be individually manufactured and coupled to a corresponding location in the device main body 3110*a*, but the rotation guide 3130*a* is integrally manufactured with the device main body 3110*a* if the rotation guide 3130*a* is made of an injection material.

Meanwhile, when water collides against the air and air partially remains, the residual air, particularly, oxygen is generated into micro-sized bubbles, and for efficiency of generation of the micro-sized bubbles, the flow of the air into the device main body 3110*a* should preferably be fast and the flow of water colliding against the air should preferably be fast.

Also, when the water collides against the air based on a rotation method, an efficiency improvement can be expected. For this, the rotation guide 3130*a* is provided.

The rotation guide 3130*a* includes a plurality of guiding walls 3140*a* and 3150*a* arranged along an imaginary line that connects the air inlet 3111 a and a water outlet 3115*b* while allowing flow of water into the water outlet 3115*a* from the water inlet 3113*a*.

In the present exemplary embodiment, the plurality of guiding walls 3140*a* and 3150*a* include a first guiding wall 3140*a* and a second guiding wall 3150*a* disposed in an external side along a radius direction. The first guiding wall 3140*a* and the second guiding wall 3150*a* are formed in the shape of a pipe.

A first end of the first guiding wall 3140*a* is fixed to one side inner wall of the device main body 3110*a* where the water outlet 3115*a* is formed while surrounding the area of the water outlet 3115*a*, and a second end of the first guiding wall 3140*a* is separately disposed from the other side inner wall where the air inlet 3111*a* is formed.

The second guiding wall 3150*a* is disposed in an outer side of the radius direction of the first guiding wall 3140*a* and forms a gap with the first guiding wall 3140*a*, and one end of the second guiding wall 3150*a* is fixed to the other inner wall that opposes the one inner wall of the device main body 3110*a* where the air inlet 3111*a* is formed and the other end is disposed at a distance from the one inner wall of the device main body 3110*a* where the water outlet 3115*a* is formed.

Operation of the rotating unit having the above-described configuration according to the present exemplary embodiment will now be described.

Air flows into the device main body 3110*a* through the air inlet 3111*a*, and water flows into the device main body 3110*a* through the water inlet 3113*a*.

The inflow water forms a flow marked by the arrow of FIG. 28 while rotating the rotation guide 3130*a* including the first guiding wall 3140*a* and the second guiding wall 3150*a*, and then efficiently collides at a high speed against air having flowed into through the air inlet 3111*a*, and accordingly many more micro-sized bubbles can be effectively generated.

As described, the generation amount of micro-sized bubbles compared to the amount of water and air used can be increased with such a simple structure and particles of micro-sized bubbles can be uniform according to the present exemplary embodiment, and accordingly the micro-sized bubble generator according to the present exemplary embodiment can be widely utilized in various fields that require micro-sized bubbles.

Hereinafter, the exemplary embodiments of the present invention will be described with reference to FIG. 29 to FIG. 46. In description of exemplary embodiments, a description of a portion that is the same as the first exemplary embodiment will be omitted, and numeral references of the exemplary embodiments will be changed by changing lower case letters at the end of the reference numerals.

In addition, the rotation arrow shown in FIG. 28 denotes flow of water, and micro-sized bubbles are generated while forming the same flow of water in the following exemplary embodiments, but the rotation arrow will not be illustrated in the drawings for convenience of description.

Figure 29:
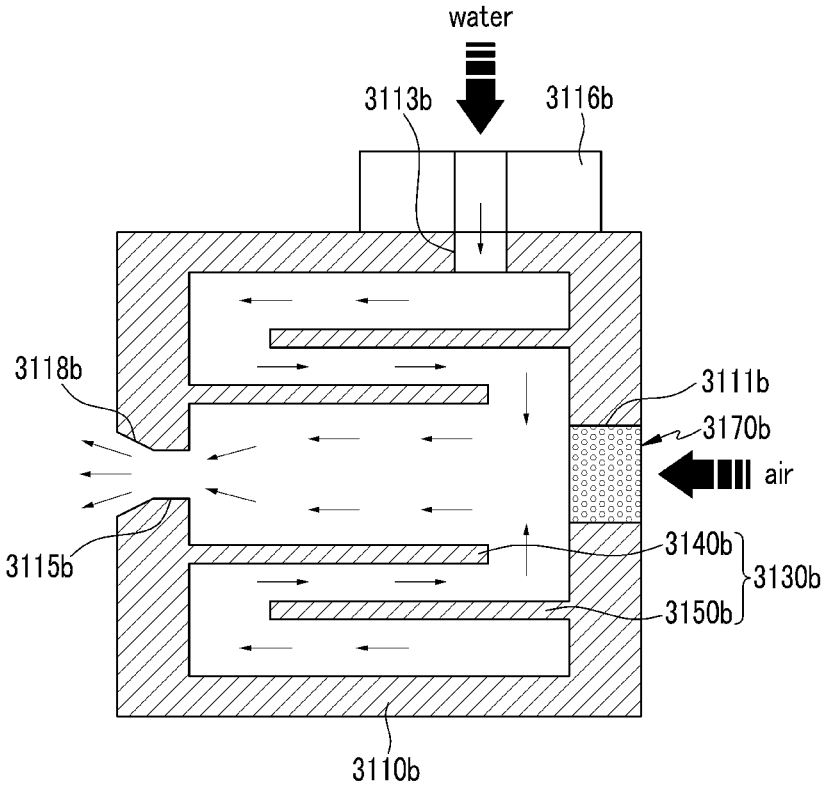
FIG. 29 is a cross-sectional view of a rotating unit according to an exemplary embodiment of the present invention.

FIG. 29 is a cross-sectional view of a rotating unit according to the second exemplary embodiment of the present invention.

The rotating unit according to the second exemplary embodiment shown in FIG. 29 is the same as the rotating unit of the first exemplary embodiment, except that a porous air guiding member 3170*b* formed in an area of an air inlet 3111*b* is further included.

The porous air guiding member 3170*b* is formed of a material having a plurality of microholes, and when air passes through the porous air guiding member 3170*b*, the size of air particles is decreased first and thus they become microparticles, and then the microparticles flow into the device main body 3110*b* such that micro-sized bubbles can be further conveniently generated.

That is, the particle size of the inflow air is maintained to be small by the porous air guiding member 3170*b*, and a rotating flow velocity is formed to increase the flow velocity in the inner wall rather than in the center area of the pipe so that further finer micro-sized bubbles can be effectively generated.

The porous air guiding member 3170*b* may be formed using a method for molding into a desired size with a material like a sponge, or may be formed of a plastic of a metal injection material while artificially forming micropores therein.

If the porous air guiding member 3170*b* is formed of the plastic or metal injection material, the inflow direction and spray direction of air can be controlled, thereby providing a further excellent effect.

Figure 30:
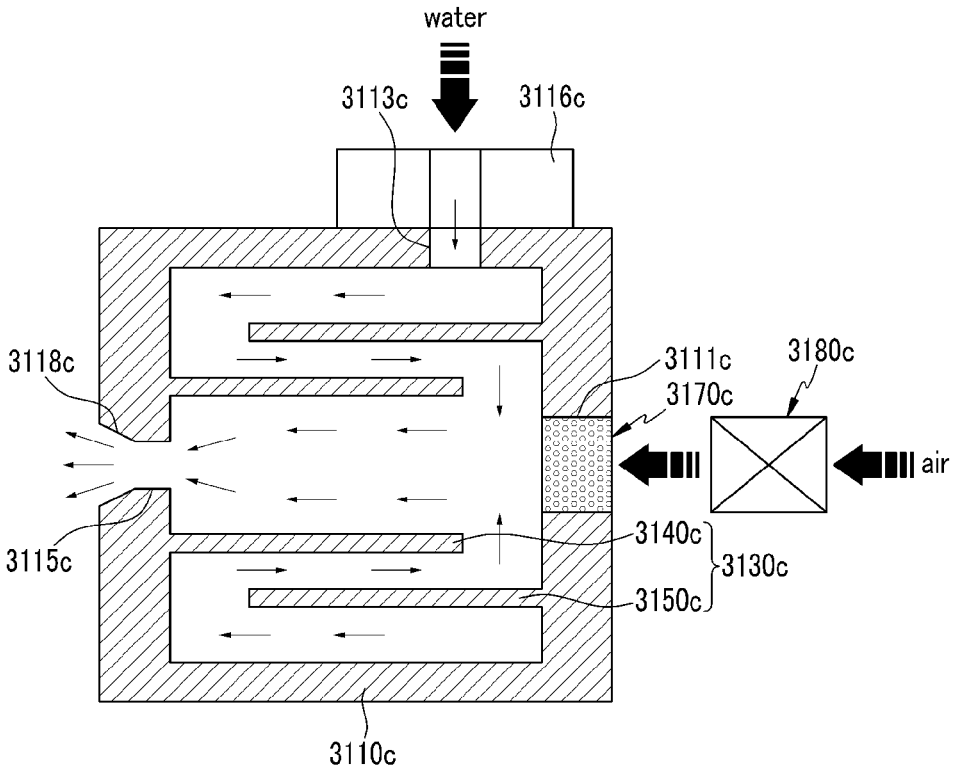
FIG. 30 is a cross-sectional view of a rotating unit according to an exemplary embodiment of the present invention.

FIG. 30 is a cross-sectional view of a rotating unit according to a third exemplary embodiment of the present invention.

The rotating unit according to the third exemplary embodiment is the same as that of the second exemplary embodiment, except that a negative ion generator 3180*c* disposed at an external side of a device main body 3110*c*, generating negative ions, and guiding negative air ions toward a porous air guiding member 3170*c* of an air inlet 3111*c* is further included.

When the negative ion generator 3180*c* is provided, negatively ionized air can be provided so that micro-sized bubbles can be further effectively generated.

Cosmic rays or radiation in the atmosphere collide with molecules in the air, electrons are emitted from the molecules, and the emitted electrons are absorbed to molecules (e.g., oxygen, nitrogen, carbon dioxide, and the like) in the air and thus become negatively ionized. The emitted electrons are coupled with water molecules in the air and exist in a stable state.

The size of negative ions is substantially known as 0.5 nm to 1 nm, and air particles become micro-sized after passing through the negative ion generator 3180*c* and are then supplied to the device main body 3110*c*, and accordingly micro-sized bubbles can be further effectively generated.

Further, another excellent effect can be provided when the negative ion generator 3180*c* is additionally included.

For example, since it has been reported that negative ion have significant effects in purification of blood, increase of resistance, control of automatic nervous system, air purification, elimination of dust, and sterilization, the rotating unit can be used in more various fields by applying such an effect.

Various contaminous substances such as cigarette smoke, sulfurous acid gas, nitrogen oxide, cabon monoxide, ozone, and various organic materials existing in the air form positive ions, but the negative ions eliminate the positive ions by curing and precipitating them to make air clean and fresh.

In addition, the positive ions make air turbid by letting virus, dust, pollen mold, and contaminated particles float freely, but the negative ions neutralize and eliminate them.

Since such an effect can be provided, further excellent effect can be provided when the ionized micro-sized bubbles are used to improve water quality.

Figure 31:
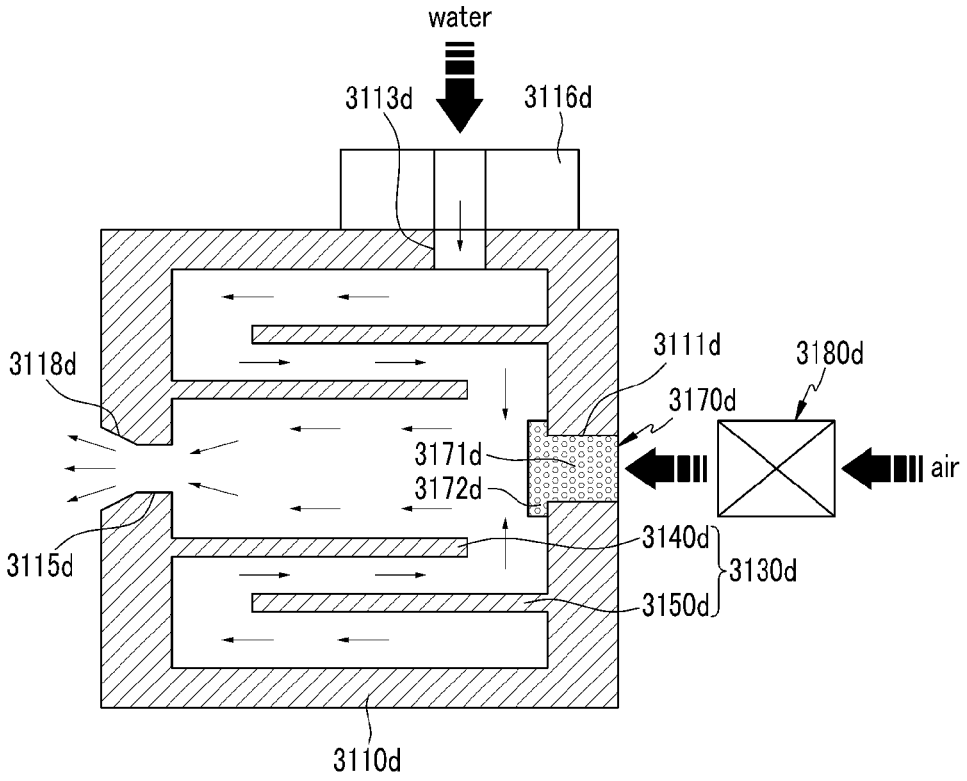
FIG. 31 is a cross-sectional view of a rotating unit according to an exemplary embodiment of the present invention.

FIG. 31 is a cross-sectional view of a rotating unit according to a fourth exemplary embodiment of the present invention.

The rotating unit of the fourth exemplary embodiment is the same as that of the third exemplary embodiment in that the rotating unit includes a porous air guiding member 3170*d* and a negative ion generator 3180*d*, but the structure of the porous air guiding member 3170*d* is different from that of the third exemplary embodiment.

That is, the porous air guiding member 3170*d* of the present exemplary embodiment includes an insertion axis 3171*d* inserted to an air inlet 3111*d* area and a head 3172*d* connected with the insertion axis 3171*d* and disposed in a device main body 3110*d*. The head 3172*d* has a relatively large cross-sectional diameter compared to the insertion axis 3171*d*.

When the porous air guiding member 3170*d* having such a structure is applied, negatively ionized microparticles having flowed into the insertion axis 3171*d* of the porous air guiding member 3170*d* can be sprayed while spreading in an arbitrary direction from the head 3172*d*, and accordingly contact or collision with air is increased and thus many more micro-sized bubbles can be effectively generated.

Figure 32:
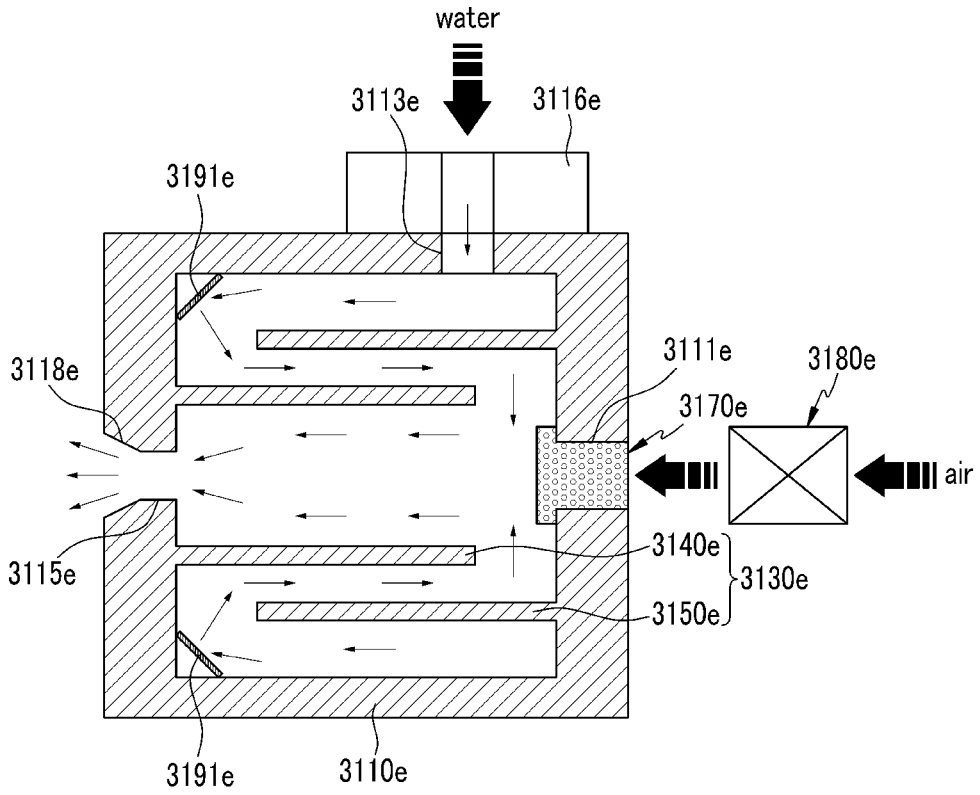
FIG. 32 is a cross-sectional view of a rotating unit according to an exemplary embodiment of the present invention.

FIG. 32 is a cross-sectional view of a rotating unit according to a fifth exemplary embodiment of the present invention.

The rotating unit according to the fifth exemplary embodiment is the same as that of the fourth exemplary embodiment in that the rotating unit includes a porous air guiding member 3170*e* and a negative ion generator 3180*e*.

However, the rotating unit of the present exemplary embodiment is different from the rotating unit of the fourth exemplary embodiment in that a first water flow guide 3191*e* is further provided in a corner area between a device main body 3110*e* and a second guiding wall 3150*e* to guide the flow of water along a direction marked by the arrow in FIG. 32.

Water having flowed in through a water inlet 3113*e* flows along a space between the device main body 3110*e* and the second guiding wall 3150*e* and is then guided by the first water flow guide 3191*e* to flow along a space between a first guiding wall 3140*e* and a second guiding wall 3150*e*, and then collides with negatively ionized microparticles such that micro-sized bubbles are generated.

The first water flow guide 3191*e* prevents generation of an eddy current when water flows so that the flow of water can be effectively induced.

Figure 33:
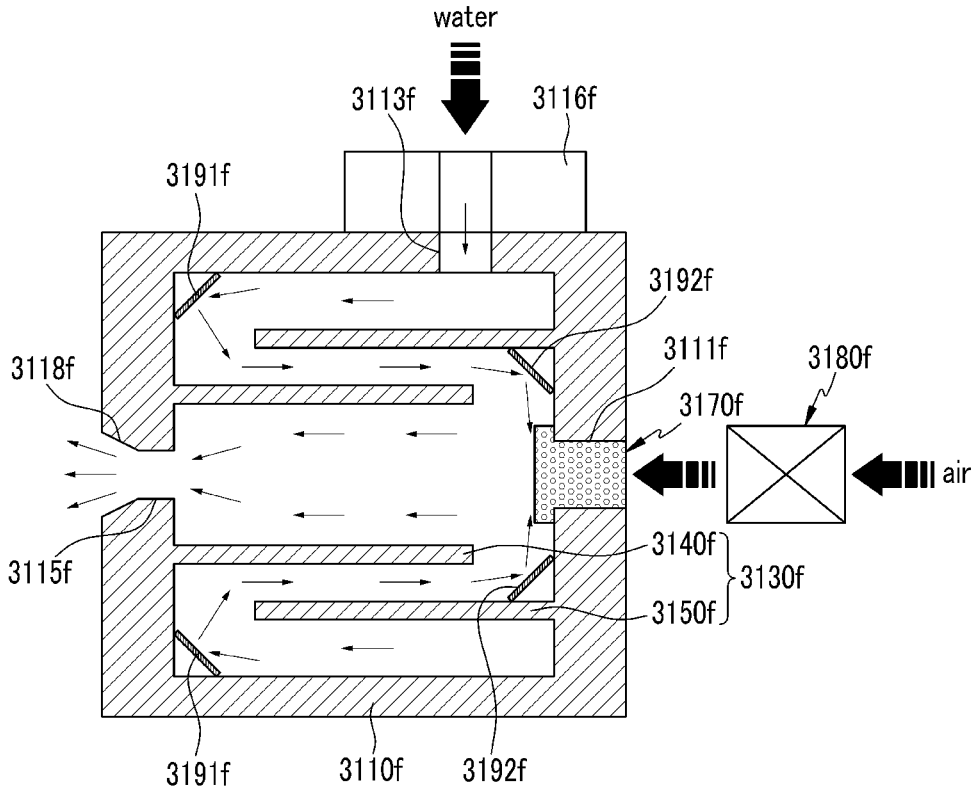
FIG. 33 is a cross-sectional view of a rotating unit according to an exemplary embodiment of the present invention.

FIG. 33 is a cross-sectional view of a rotating unit according to a sixth exemplary embodiment of the present invention.

The rotating unit of the sixth exemplary embodiment is the same as that of the fifth exemplary embodiment in that the rotating unit includes a porous air guiding member 3170*f*, a negative ion generator 3180*f*, and a first water flow guide 3191*f*.

However, the rotating unit of the present exemplary embodiment further includes a second water flow guide 3192*f* formed in a corner area between a first guiding wall 3140*f* and a second guiding wall 3150*f*. The second wall flow guide 3192*f* may be disposed with an inclination angle that is symmetrical to an inclination angle of the first water flow guide 3191*f*.

With such a structure, water having flowed in through a water inlet 3113*f* flows along a space between a device main body 3110*f* and the second guiding wall 3150*f* and is then guided by the first water flow guide 3191*f* to flow in a space between the first guiding wall 3140*f* and the second guiding wall 3150*f*. Then the water is guided again by the second water flow guide 3192*f* and thus collides with negatively ionized microparticles such that micro-sized bubbles are generated, and since no eddy current is generated in the flow of water in this case, micro-sized bubble generation efficiency can be improved and occurrence of noise can be prevented.

Figure 34:
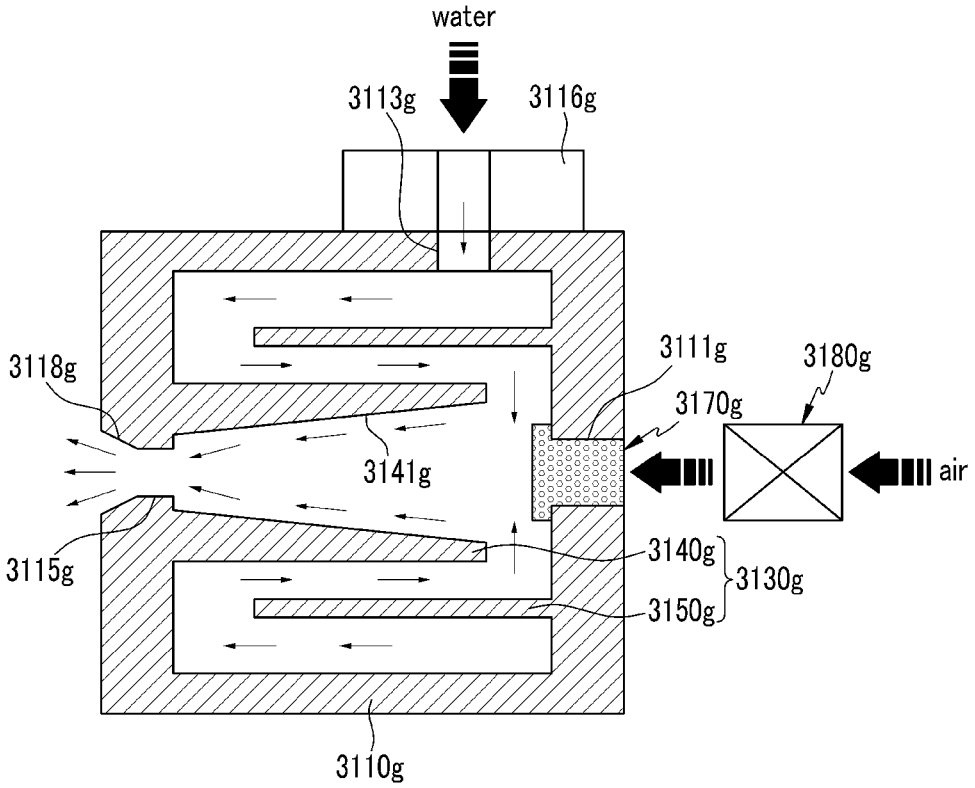
FIG. 34 is a cross-sectional view of a rotating unit according to an exemplary embodiment of the present invention.

FIG. 34 is a cross-sectional view of a rotating unit according to a seventh exemplary embodiment of the present invention.

The rotating unit of the seventh exemplary embodiment is the same as the rotating unit of the fourth exemplary embodiment shown in FIG. 31.

However, in the present exemplary embodiment, an inner wall of a first guiding wall 3140*g* forms an inclined surface 3141*g*. The inclined surface 3141*g* is narrowed toward a water outlet 3115*g*. That is, a diameter in a radius direction is gradually decreased.

In such a case, flow speed of water discharged to the water outlet 3115*g* from the inside of the first guiding wall 3140*g* where the inclined surface 3141*g* is formed can be further increased, and therefore water can be further fast and strongly collide with air by increasing the flow and speed of water, thereby increasing the generation of the micro-sized bubbles.

Figure 35:
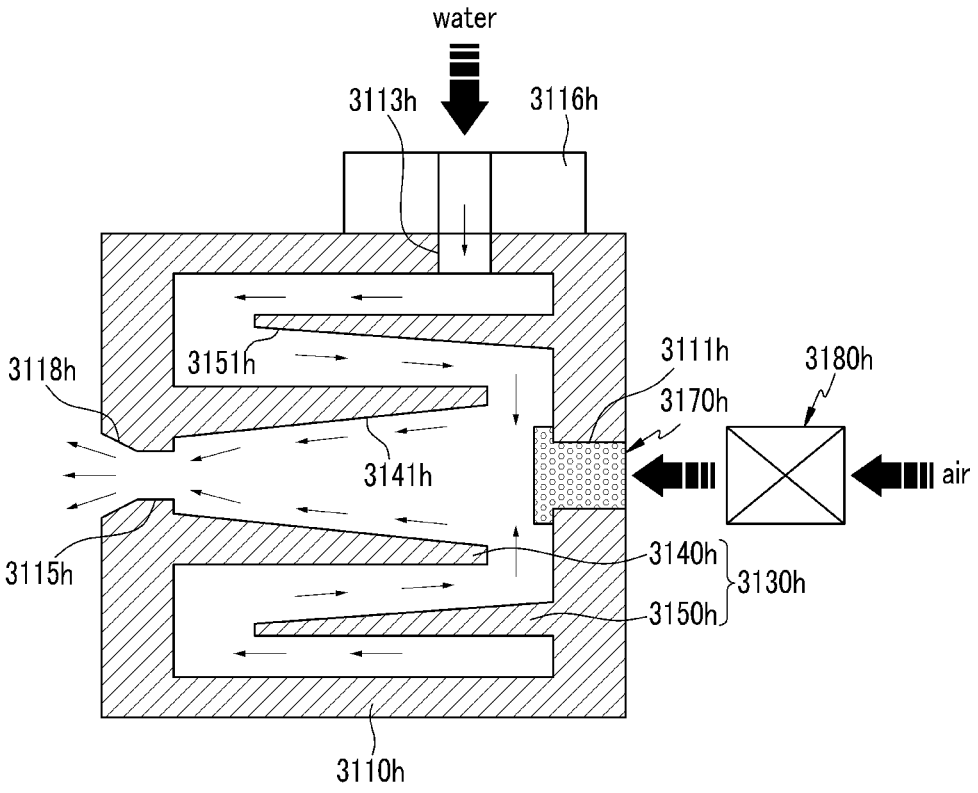
FIG. 35 is a cross-sectional view of a rotating unit according to an exemplary embodiment of the present invention.

FIG. 35 is a cross-sectional view of a rotating unit according to an eighth exemplary embodiment of the present invention.

The rotating unit of the eighth exemplary embodiment is the same as the rotating unit of the seventh exemplary embodiment, except that the rotating unit further includes an inclined surface 3151*h* formed in an inner wall of a second guiding wall 3150*h*.

The inclined surface 3151*h* formed in the inner wall of the second guiding wall 3150*h* may have a cross-section that is gradually decreased along a water flow direction.

Figure 36:
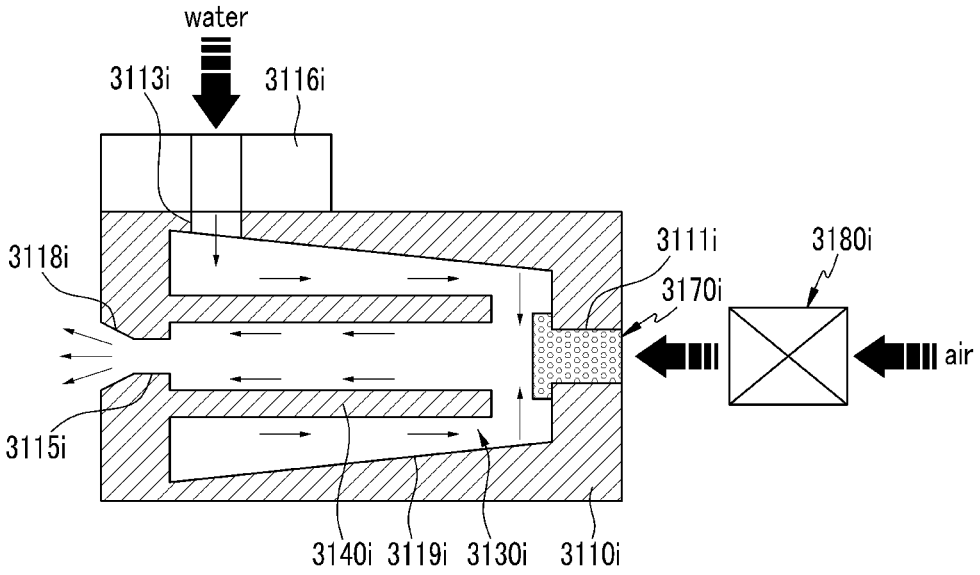
FIG. 36 is a cross-sectional view of a rotating unit according to an exemplary embodiment of the present invention.

FIG. 36 is a cross-sectional view of a rotating unit according to a ninth exemplary embodiment of the present invention.

The rotating unit of the ninth exemplary embodiment is the same as the rotating units of the above-stated exemplary embodiments, except that a first guiding wall 3140*i* is formed in a rotation guide 3130*i* and an inclined surface 3119*i* is formed in an inner wall of a device main body 3110*i* so that a cross-section of the inner wall of the device main body 3110*i* is gradually increased toward a water outlet 3115*i* from an air inlet 3111*i* while forming a cone shape.

That is, the present exemplary embodiment is the same as the above-stated exemplary embodiment, except that, for example, the function of the second guiding wall 3150*h* of the eighth exemplary embodiment is performed by the cone-shaped device main body 3110*i*.

However, when the inner wall of the device main body 3110*i* is formed in the shape of a cone as in the present exemplary embodiment, it is advantageous to move a water inlet 3113*i* to a larger inner space of the device main body 3110*i* as shown in FIG. 36.

Figure 37:
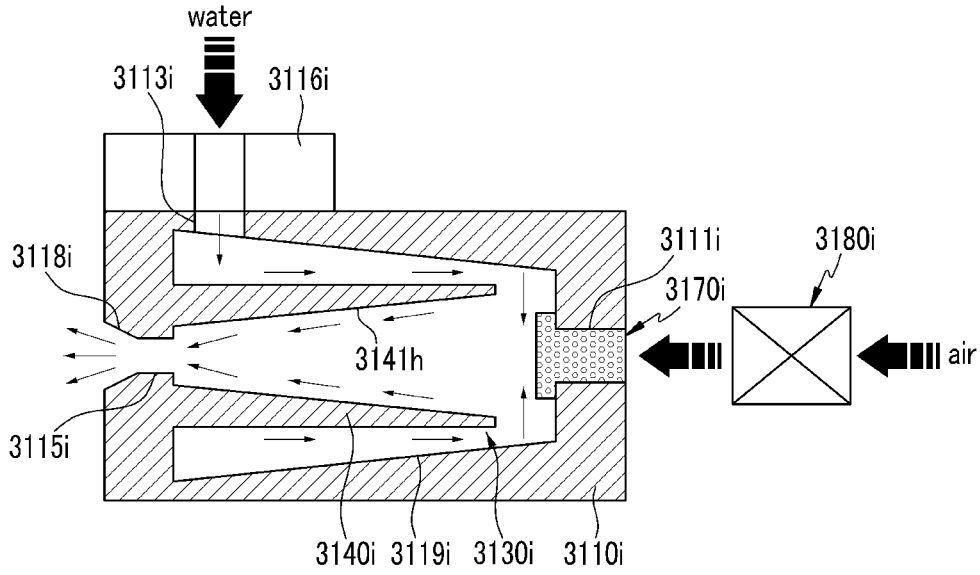
FIG. 37 is a cross-sectional view of a rotating unit according to an exemplary embodiment of the present invention.

FIG. 37 is a cross-sectional view of a rotating unit according to a tenth exemplary embodiment of the present invention.

The rotating unit of the tenth exemplary embodiment is the same as the rotating unit of the ninth exemplary embodiment in structure and function, except that an inclined surface 3141*j* of which a cross-section is gradually decreased toward a water outlet 3115*j* is formed in an inner wall of a first guiding wall 3140*j* forming a rotation guide 3130*j*.

Figure 38:
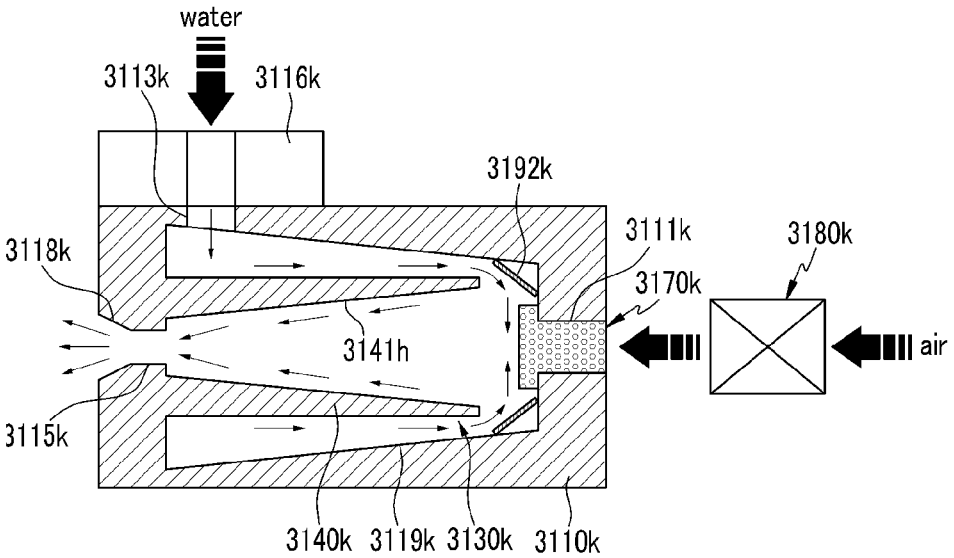
FIG. 38 is a cross-sectional view of a rotating unit according to an exemplary embodiment of the present invention.

FIG. 38 is a cross-sectional view of a rotating unit according to an eleventh exemplary embodiment of the present invention.

The rotating unit of the eleventh exemplary embodiment further includes a water flow guide 3192*k* formed in a corner area between a main body 3110*k* and a first guiding wall 3140*k*.

With such a structure, water having flowed in through a water inlet 3113*k* flows fast along a space between the device main body 3110*k* and the first guiding wall 3140*k* and is guided by the water flow guide 3192*k* and thus the water collides with negatively ionized microparticles such that micro-sized bubbles are generated. After that, a flow for quickly discharging the water along an inner space of the first guiding wall 3140*k* and a water outlet 3115*k* is formed.

Figure 39:
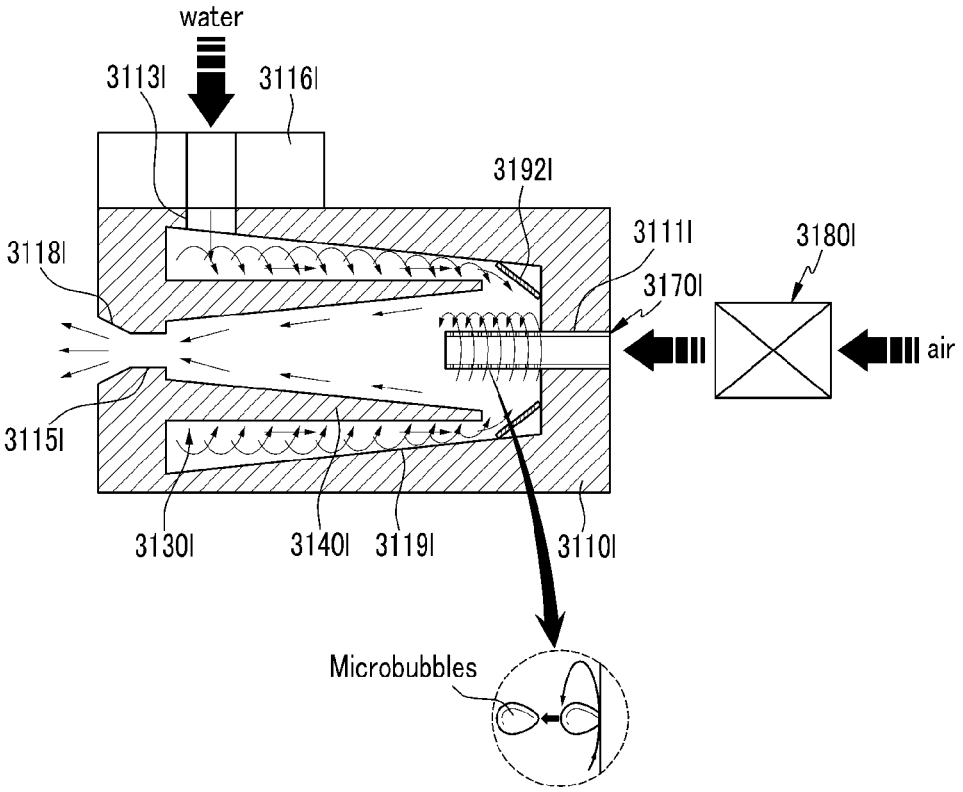
FIG. 39 is a cross-sectional view of a rotating unit according to an exemplary embodiment of the present invention.

FIG. 39 is a cross-sectional view of a rotating unit according to a twelfth exemplary embodiment of the present invention.

The rotating unit of the twelfth exemplary embodiment is the same as the rotating unit of the eleventh exemplary embodiment in structure.

However, in the present exemplary embodiment, a porous air guiding member 3170*l* (here, l is the lowercase of L) is formed as a circular cylinder pipe where a plurality of microholes are formed in the surface thereof, and the effect of the present invention can be provided without any problem even though the porous air guiding member 3170*l* is formed in the circular cylinder pipe.

In this case, it is preferred that one end of the porous air guiding member 3170*l* is coupled to an air inlet 3111*l* but a free end is partially inserted into a first guiding wall 3140*l* for the purpose of efficiency.

When the flow speed is fast compared with the flow amount, inflow water and air collide with each other more quickly so that the size of the bubbles is decreased, and the flow speed in the inner wall side can be further increased when the water flows while rotating rather than flowing straight so many more micro-sized bubbles can be generated. In particular, inflow of air provided from the porous air guiding member 3170*l* can be increased in many locations when the porous air guiding member 3170*l* has a long length so that the generation amount of micro-sized bubbles per unit hour can be increased.

Referring to FIG. 39, the inflow air and water collide with each other more quickly when the flow speed is fast compared to the same flow amount so that the size of the bubbles is generally decreased. In this case, when the water flows straight along the diameter of the pipe, the flow speed is increased in the center area and slowed in an inner wall area of the pipe. However, when the water flows while rotating as in the present exemplary embodiment, the flow speed is further increased at the inner wall rather than in the center area so that the water quickly and efficiently collides with the inflow air and thus micro-air from the porous air guiding member 3170*l* is divided thereby generating many more micro-sized bubbles. This can be equivalently applied to the following exemplary embodiment.

Figure 40:
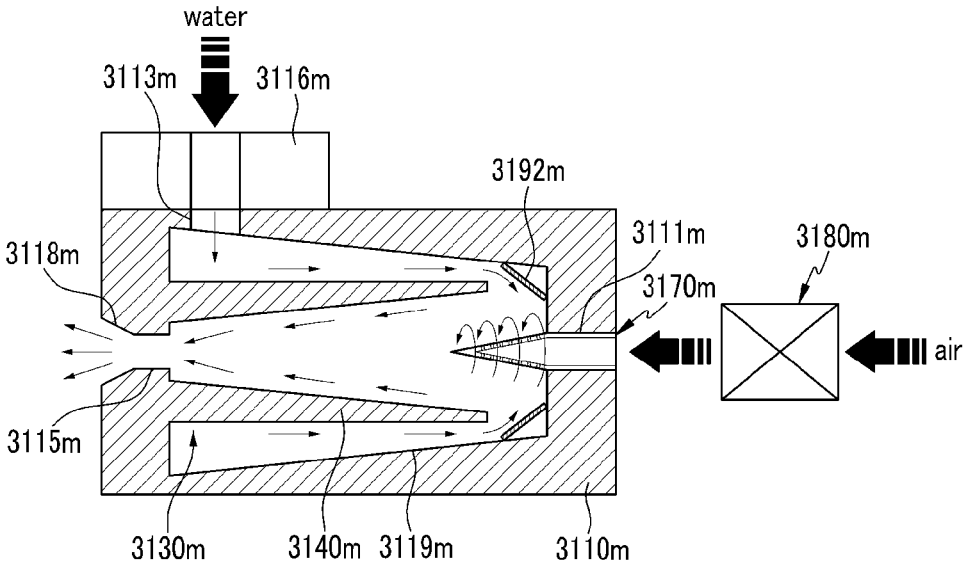
FIG. 40 is a cross-sectional view of a rotating unit according to an exemplary embodiment of the present invention.

FIG. 40 is a cross-sectional view of a rotating unit according to a thirteenth exemplary embodiment of the present invention.

The rotating unit of the thirteenth exemplary embodiment is the same as the rotating unit of the twelfth exemplary embodiment, except that a porous air guiding member 3170*m* having a plurality of microholes formed in the surface thereof is formed in the shape of a cone-shaped pipe.

Figure 41:
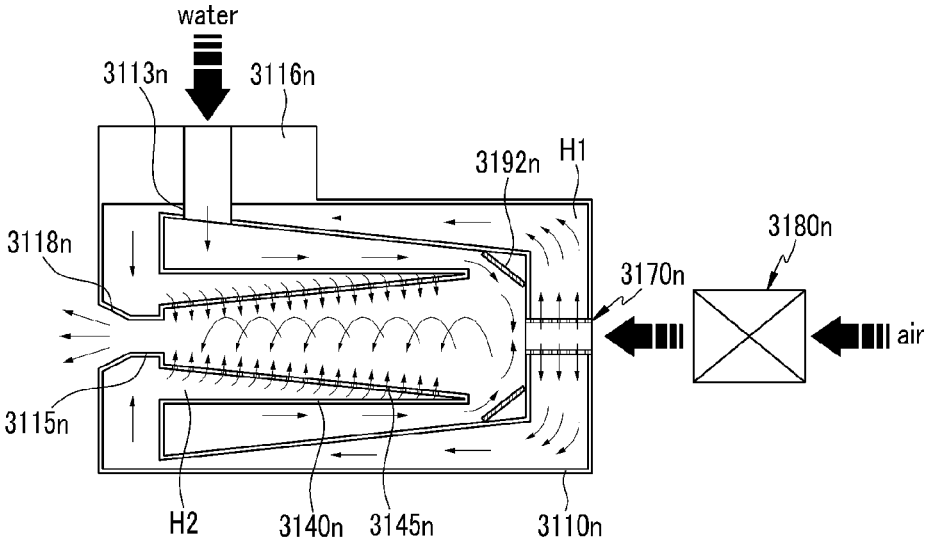
FIG. 41 is a cross-sectional view of a rotating unit according to an exemplary embodiment of the present invention.

FIG. 41 is a cross-sectional view of a rotating unit according to a fourteenth exemplary embodiment of the present invention.

The rotating unit according to the fourteenth exemplary embodiment has a structure in which a device main body 3110*n* and a guiding wall 3140*n* are formed in a hollow body such that air can flow through the device main body 3110*n* and the guiding wall 3140*n*, and a plurality of micropore holes 3145*n* are formed in an inner wall of the guiding wall 3140*n*. In addition, a porous air guiding member 3170*n* is coupled to the device main body 3110*n* to inlet air to an inner hollow hole H1 of the device main body 3110*n*.

With such a structure, air from a negative ion generator 3180*n* flows through the porous air guiding member 3170*n* and the hollow hole H1 of the device main body 3110*n* and then discharged through the plurality of micropore holes 3145*n* formed in the inner wall of the guiding wall 3140*n* via an inner hollow hole H2 of the guiding wall 3140*n*, and water flows while rotating and collides with the air discharged through the micropore holes 3145*n* such that the air is broken up, thereby generating micro-sized bubbles. The effect of the present invention can be provided without any problem even though such a structure is applied.

Figure 42:
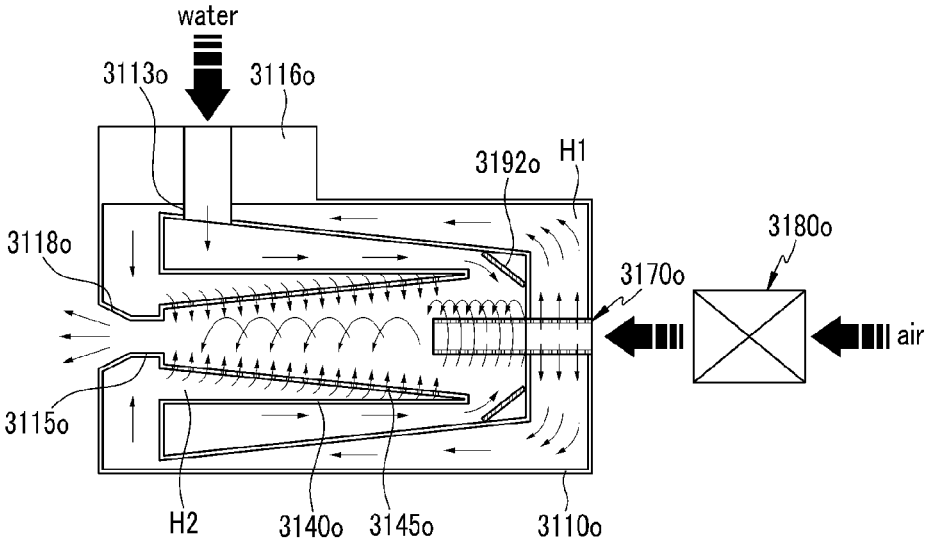
FIG. 42 and FIG. 43 are cross-sectional views of the rotating units of the exemplary embodiments of FIG. 40 and FIG. 41.
Figure 43:
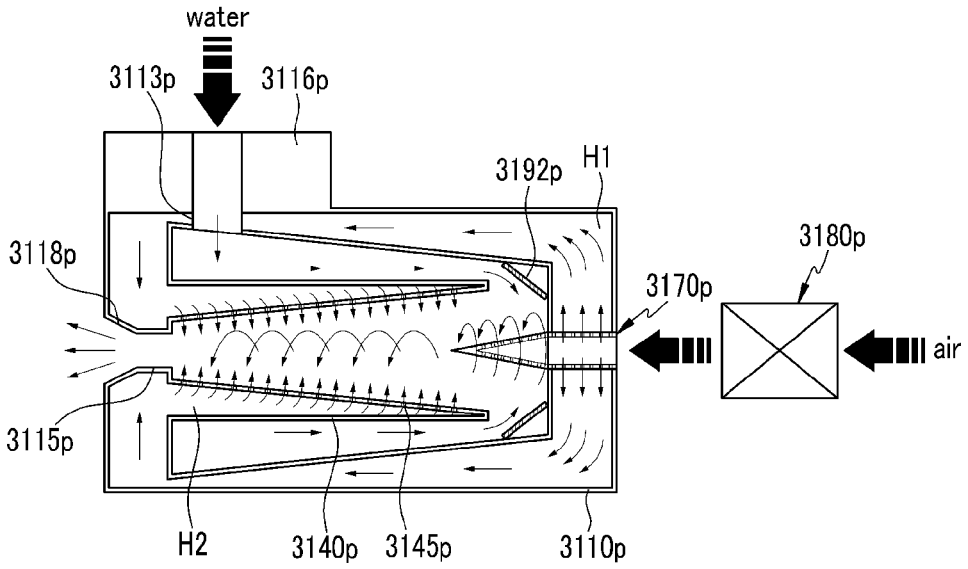

FIG. 42 and FIG. 43 are cross-sectional views of rotating units according to fifteenth and sixteenth exemplary embodiments of the present invention.

The structures of the twelfth and thirteenth exemplary embodiments are applied together to the structure of the fourteenth exemplary embodiment. In case of the exemplary embodiments of FIG. 43 and FIG. 43, air can be discharged to various locations and a large amount of air can be discharged so that efficiency in generation of micro-sized bubbles can be improved.

Figure 44:
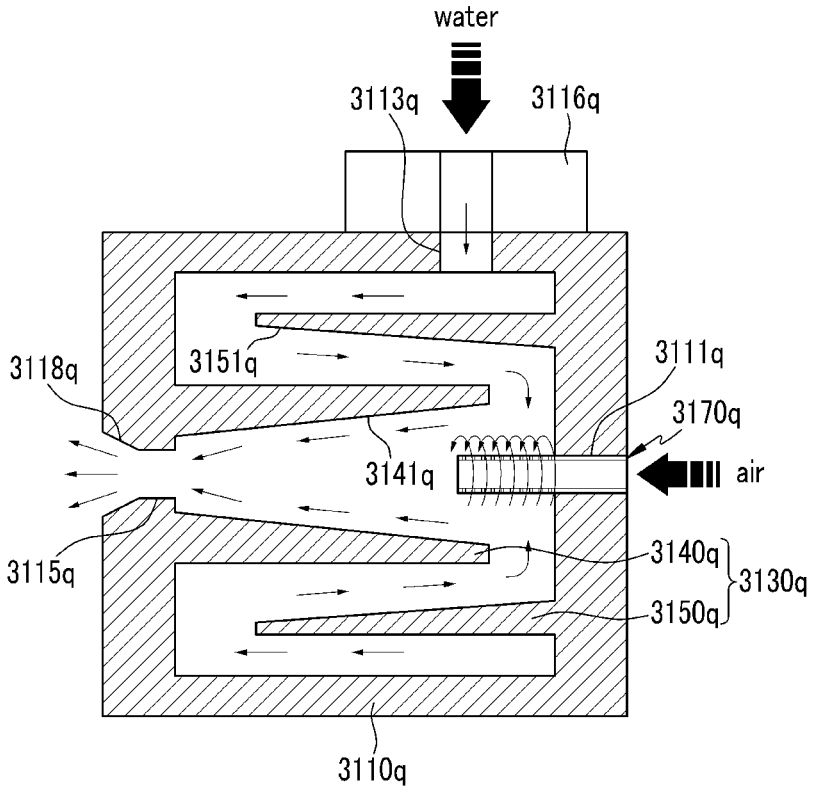
FIG. 44 is a cross-sectional view of a rotating unit according to an exemplary embodiment of the present invention.

FIG. 44 is a cross-sectional view of a rotating unit according to a seventeenth exemplary embodiment of the present invention.

The rotating unit according to the seventeenth exemplary embodiment is the same as the rotating unit of the eighth exemplary embodiment of FIG. 35 in structure. That is, a rotation guide 3130*q* includes first and second guiding walls 3140*q* and 3150*q*.

However, a porous air guiding member 3170*q* of the present exemplary embodiment is formed as a circular cylinder pipe of which a plurality of microholes are formed in the surface thereof, and one end of the porous air guiding member 3170*q* is coupled to an air inlet 3111*q* but a free end is partially inserted into the first guiding wall 3140*q*.

When the flow speed is fast compared with the flow amount, inflow water and air collide with each other more quickly so that the size of the bubbles is decreased, and the flow speed at the inner wall side can be further increased when the water flows while rotating rather than flowing straight so many more micro-sized bubbles can be generated. In particular, as the present exemplary embodiment, when a free end of the porous air guiding member 3170*q* having a long length is partially inserted into the first guiding wall 3140*q*, air can be supplied through many places from the porous air guiding member 3170*q* so that the generation amount of micro-sized bubbles per unit hour can be increased.

Figure 45:
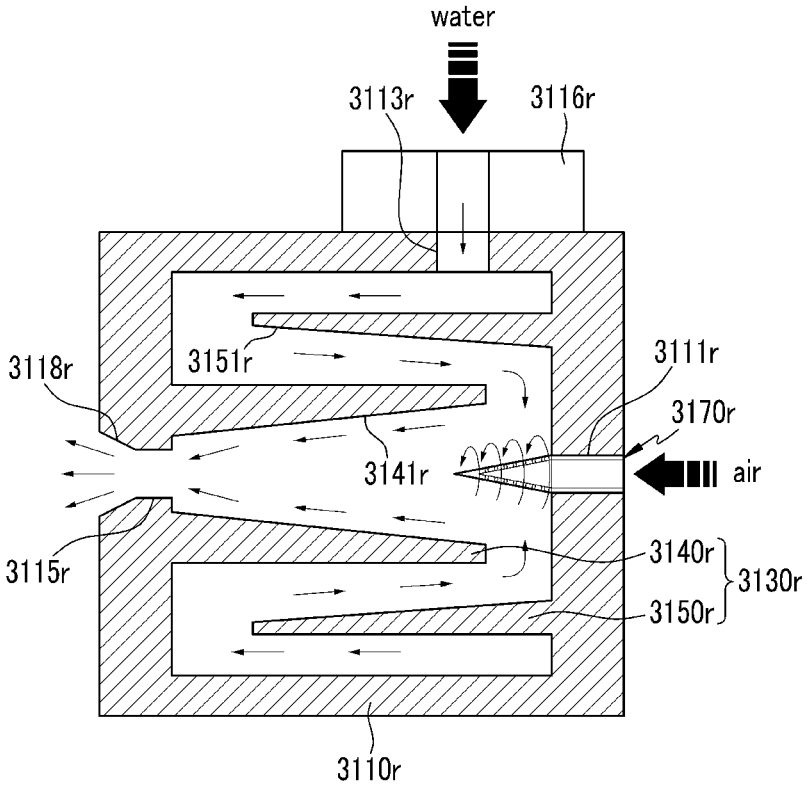
FIG. 45 is a cross-sectional view of a rotating unit according to an exemplary embodiment of the present invention.

FIG. 45 is a cross-sectional view of a rotating unit according to an eighteenth exemplary embodiment of the present invention.

The rotating unit of the eighteenth exemplary embodiment is the same as the rotating unit of the seventeenth exemplary embodiment, except that a porous air guiding member 3170*r* is formed as a cone-shaped pipe of which a plurality of microholes are formed in the surface thereof.

Figure 46:
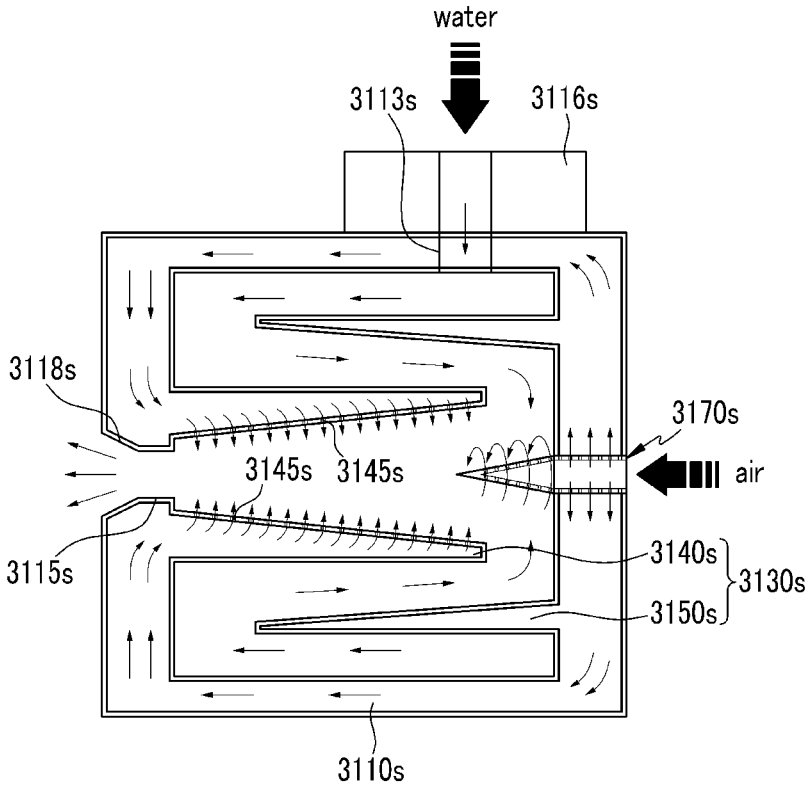
FIG. 46 is a cross-sectional view of a rotating unit according to an exemplary embodiment of the present invention.

FIG. 46 is a cross-sectional view of a rotating unit according to a nineteenth exemplary embodiment of the present invention.

The rotating unit of the nineteenth exemplary embodiment has a structure in which a device main body 3110*s* and first and second guiding walls 3140*s* and 3150*s* are formed as a hollow body so that air can flow therethrough, and a plurality of micropore holes 3145*s* are formed in an inner wall of the first guiding wall 3140*s*. In addition, the porous air guiding member 3170*s* has a structure in which air can flow not only into the inner space of the device main body 3110*s* and but also into the inner space of the first guiding wall 3140*s*.

With such a structure, air having flowed in from the porous air guiding member 3170*s* flows along two paths and collides with rotating water so that many more micro-sized bubbles can be generated per unit hour or unit size.

Figure 47:
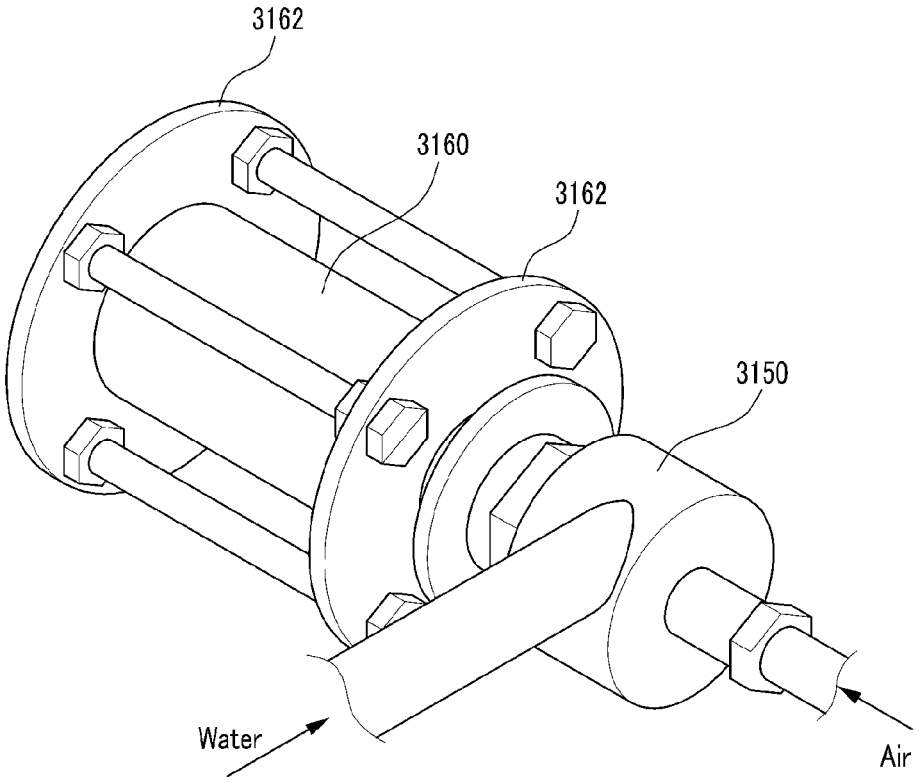
FIG. 47 is provided for description of the rotating unit and the separation chamber of FIG. 24.

FIG. 47 is provided for description of a separation chamber and a rotating unit of FIG. 23. FIG. 47 exemplarily shows the separation chamber 3160 and the rotating unit 3150 in a coupled state. As shown in FIG. 47, the separation chamber 3160 and the rotating unit 3150 are coupled to each other, and the rotating unit 3150 receives a solution discharged from the pump 3130 in a tangent line direction of the rotating unit 3150. Here, the separation chamber 3160 may be the same as the separation chamber 160 of FIG. 5 in configuration, and in this case, the separation chamber 3160 is formed in the shape of a hollow cylinder and is coupled with a pair of substrates 3162. The substrates 3162 include openings for receiving a solution and discharging the solution, respectively, and the substrates 3162 and the separation chamber 3160 are coupled to each other such that the flow of the solution is continued through the openings and the separation chamber 3160.

Meanwhile, the separation chamber 3160 and the rotating unit 3150 may be fastened using a fastening means such as a screw, and the separation chamber 3160, the openings of the substrates 3162, and a solution outlet 3155 of the rotating unit 3150 are connected with each other for continuous flow of the solution. That is, the solution discharged from the solution outlet 3155 is passed through the openings of the substrates 3162 and flows into one end of the cylinder-shaped separation chamber 3160. After that, the solution having flowed into the separation chamber 3160 is discharged through the other end of the separation chamber 3160, and the discharged solution is moved to the dissolving tank.

The rotating unit 3150 according to the present exemplary embodiment receives air through one side and receives water through a pump 3130 to mix the two through collision.

Figure 48:
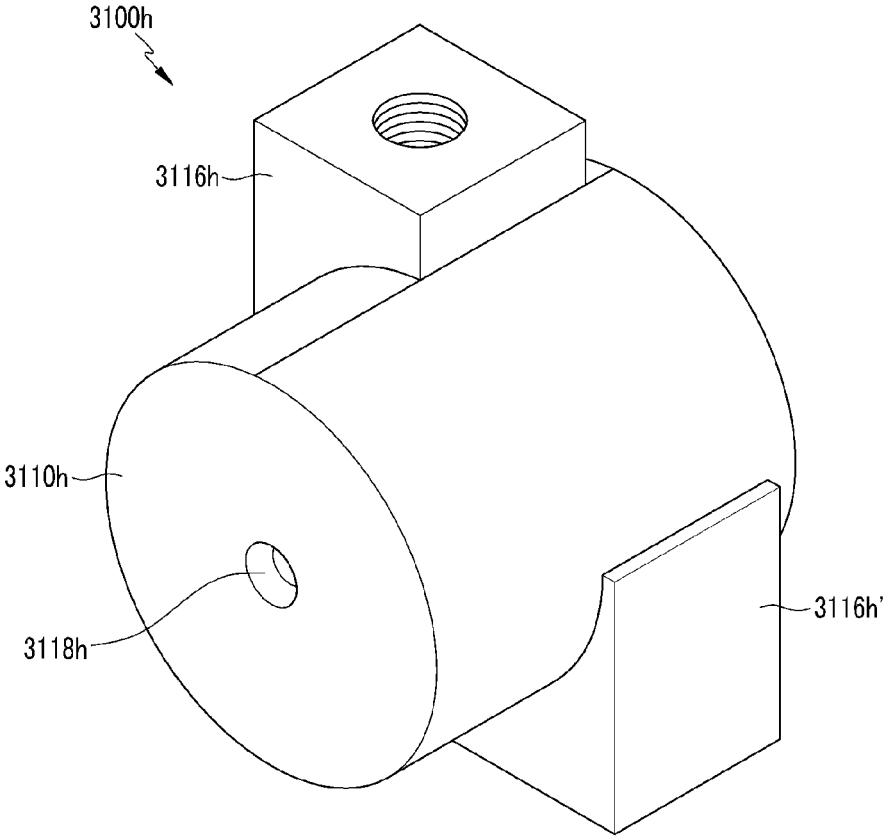
FIG. 48 is a perspective view of an exemplary embodiment of the rotating unit.
Figure 49:
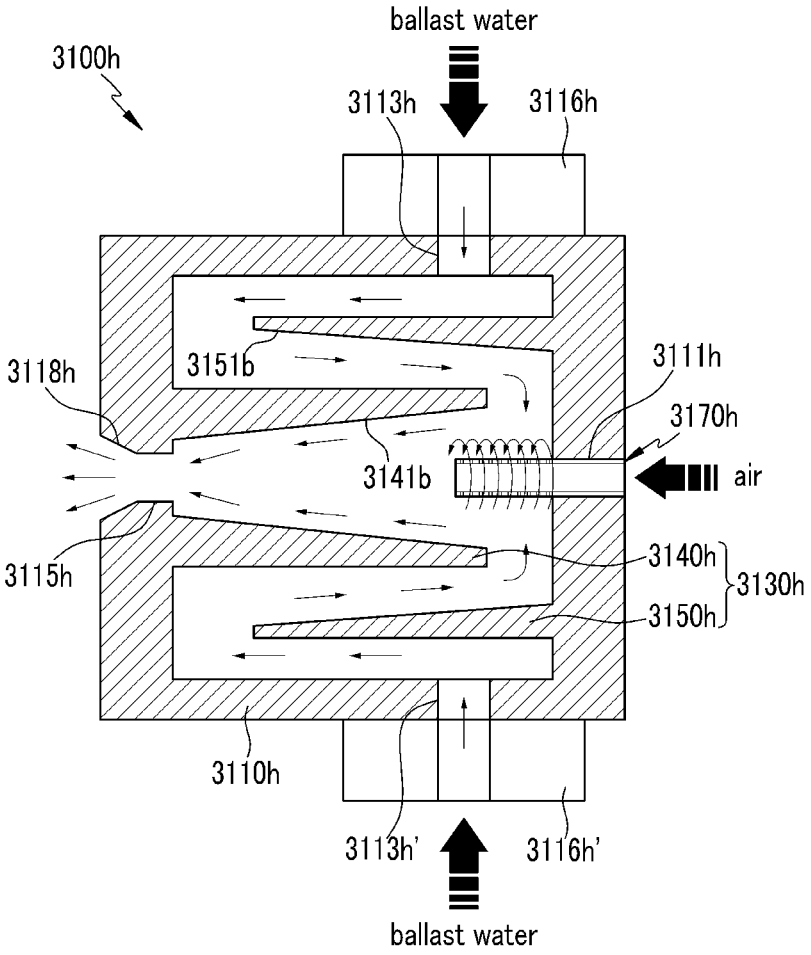
FIG. 49 is a cross-sectional view of FIG. 48.

FIG. 48 is a cross-sectional view of a rotating unit according to an exemplary embodiment, and FIG. 49 is a cross-sectional view of FIG. 48.

Unlike the above-stated exemplary variations, a micro-sized bubble generation unit 3100*h* shown in the drawing is provided with a water supply connector 3116*h*' at both sides of a device main body 3110*h* such that water flows at the corresponding location through a water inlet 3113*h*'. With such a structure, water can be supplied into the device main body 3110*h* from several places so that many more micro-sized bubbles can be generated.

Figure 50:
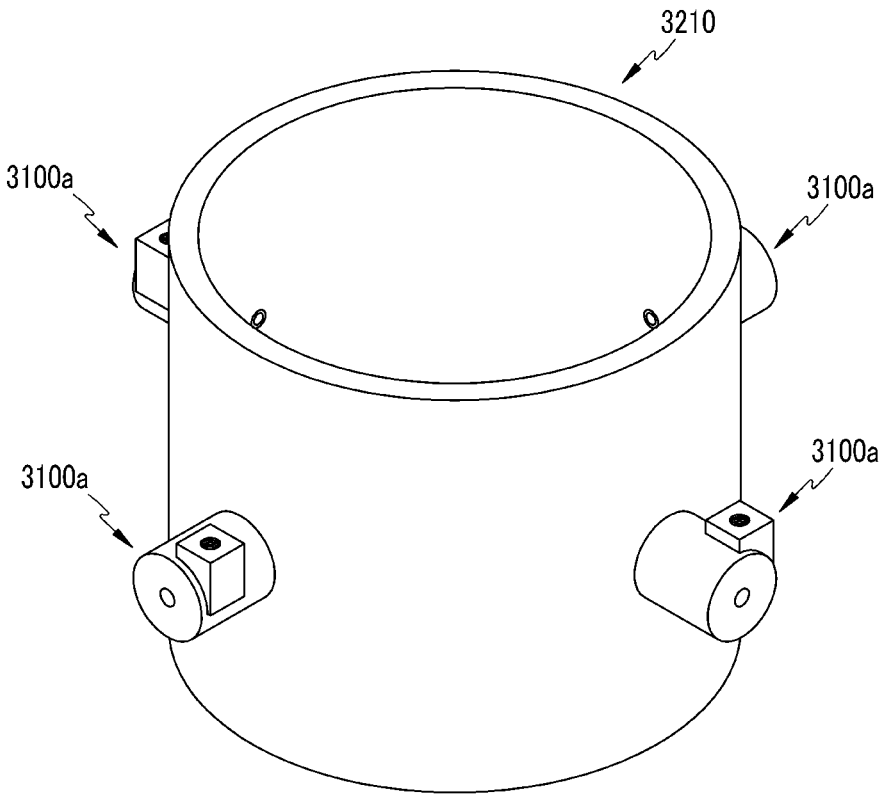
FIG. 50 is an enlarged perspective view illustrating a nozzle unit that is mounted to a main line through which treatment target water flows according to an exemplary embodiment of the present invention.
Figure 51:
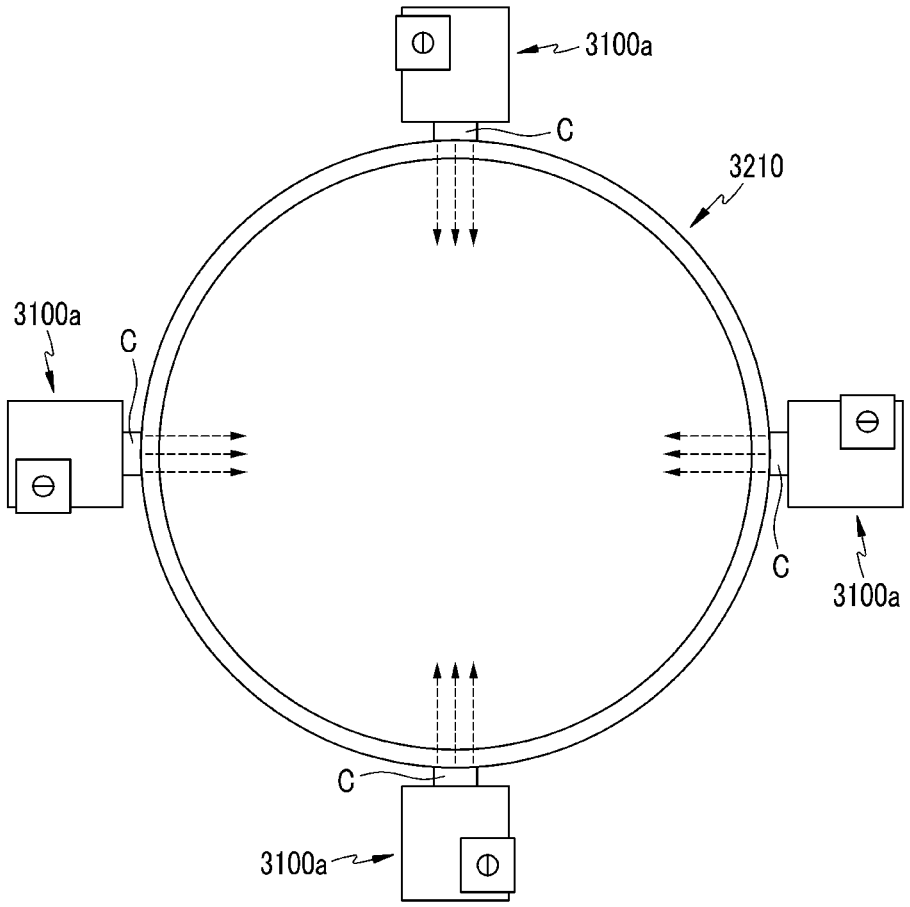
FIG. 51 is a cross-sectional view of FIG. 50.
Figure 52:
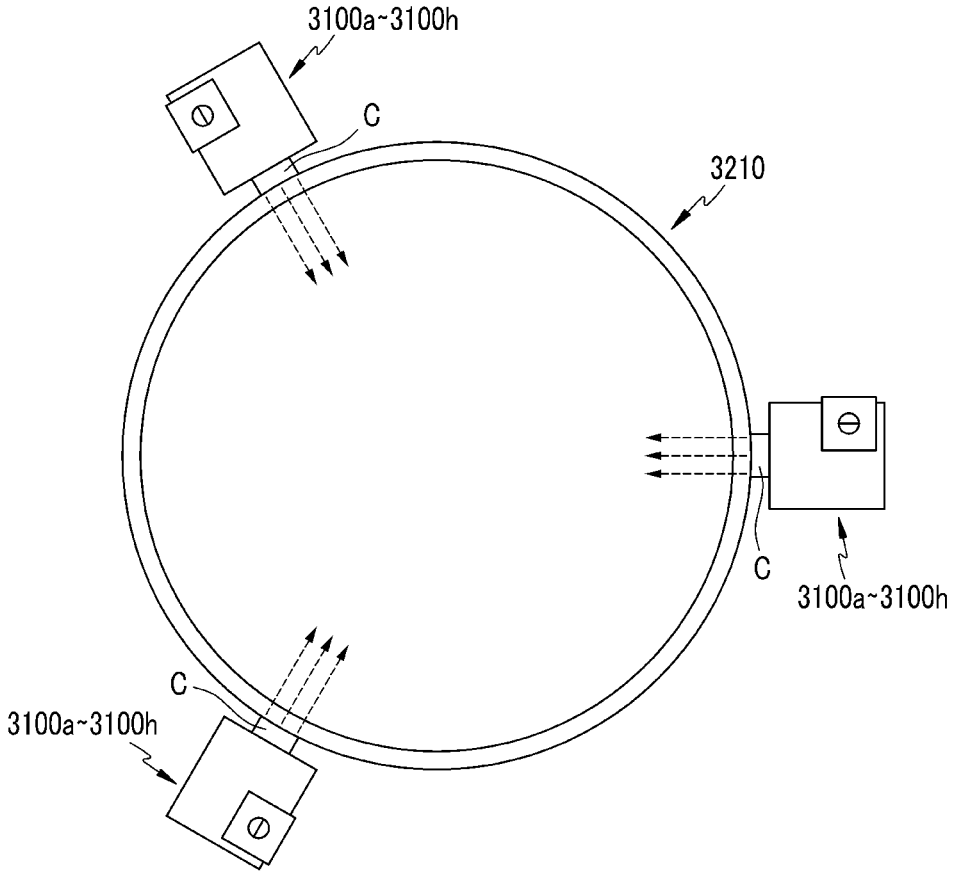
FIG. 52 is a cross-sectional view illustrating a nozzle unit that is mounted to a main line through which treatment target water flows according to another exemplary embodiment of the present invention.
Figure 53:
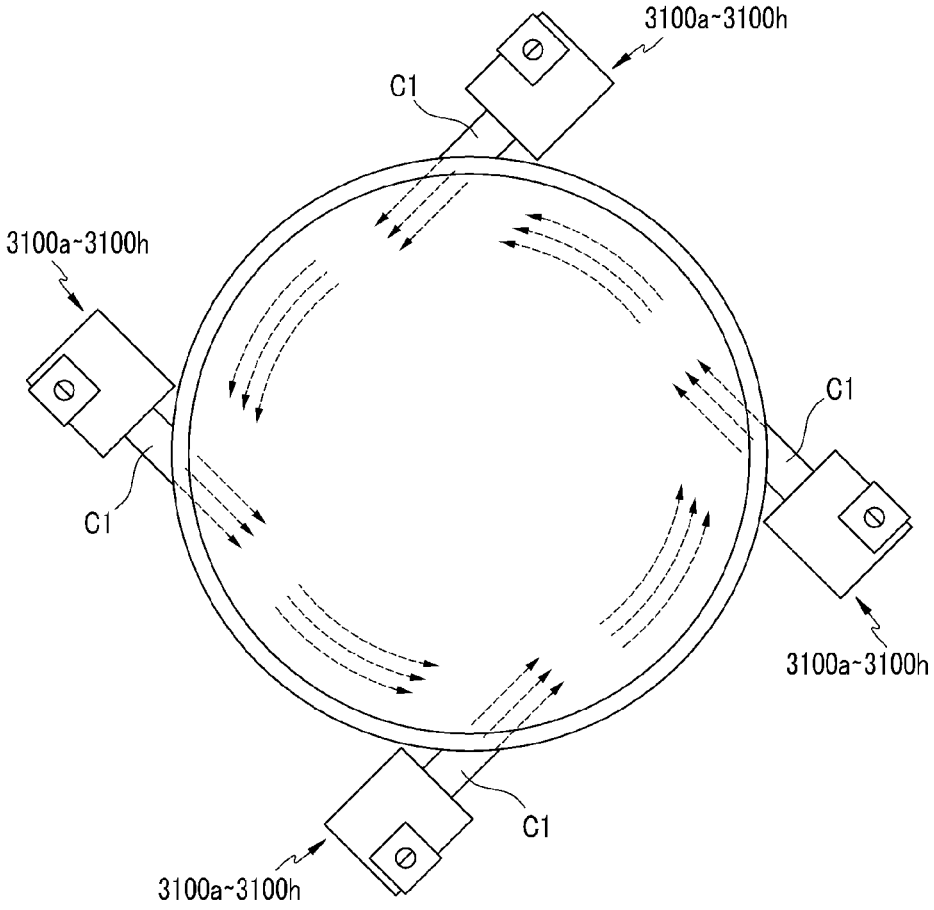
FIG. 53 is a cross-sectional view illustrating a nozzle unit that is mounted to a main line according to another exemplary embodiment of the present invention.

FIG. 50 to FIG. 53 respectively show exemplary uses of a nozzle unit according to an exemplary embodiment of the present invention. FIG. 50 is an enlarged perspective view of a nozzle unit mounted to a main line through which treatment target water flows according to an exemplary embodiment of the present invention, FIG. 51 is a cross-sectional view of FIG. 50, FIG. 52 is a cross-sectional view of a nozzle unit mounted to a main line through which treatment target water flows according to another exemplary embodiment of the present invention, and FIG. 53 is a cross-sectional view of a nozzle unit mounted to a main line according to another exemplary embodiment of the present invention.

As shown in FIG. 50 and FIG. 51, at least one nozzle unit 3100*a* may be coupled to a pipe 3210 to which micro-sized bubbles are injected.

According to the exemplary embodiment of the present invention, the nozzle unit 3100*a* can be detachably mounted to the pipe 3210. According to another exemplary embodiment of the present invention, a nozzle unit 3100*a* may be fixed to an external circumferential surface of the pipe 3210. In the present exemplary embodiment, a plurality of nozzle units 3100*a*, for example, four nozzle units 3100*a*, are arranged at the same distance from each other along a circumference direction of the pipe 3210. In this case, the nozzle units 3100*a* are coupled along the circumference direction (i.e., a direction toward the center of the main line) of the pipe 3210 so that micro-sized bubbles generated by the nozzle units 3100*a* are provided to the pipe 3210 along a radius direction (i.e., dotted arrow direction of FIG. 53) of the pipe 3210 and mixed with the treatment target water flowing through the pipe 3210.

Referring to FIG. 52, the four nozzle units 3100*a* of the exemplary embodiment of FIG. 51 are coupled at the same distance along the circumference direction of the pipe 3210, but three nozzle units 3100*a*-3100*h* are coupled in the present exemplary embodiment.

Referring to FIG. 53, in the present exemplary embodiment, the nozzle units 3100*a*-3100*h* are coupled along a tangent line direction of the pipe 3210 to provide micro-sized bubbles along the tangent line direction of an external circumferential surface of the pipe 3210. As the present exemplary embodiment, the micro-sized bubbles are supplied to the pipe 3210 along a tangent line direction (i.e., dotted arrow direction) of the pipe 3210 and mixed with treatment target water flowing through the pipe 3210 so the mixing with the treatment target water can be further increased, and accordingly the micro-sized bubbles remain for a long period of time rather than vanishing for treatment of the target water.

As described, the nozzle unit according to the present invention is detachably mounted to the pipe through which target water to be treated flows. The pipe 3210 of the present exemplary embodiment is formed in the shape as a circle, but it may have other shapes.

Alternatively, the nozzle unit is mounted to the pipe in the exemplary embodiment of FIG. 50, but the nozzles of the exemplary embodiments of the present invention may be mounted to the pipe. However, this can be allowable if the rotating unit and the nozzle unit are similar to each other in configuration.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

In addition, the rotating unit according to the exemplary embodiment of the present invention can generate nano-sized and/or micro-sized bubbles and generate nano-sized bubbles that are smaller than micro-sized bubbles. For example, the rotating unit according to the exemplary embodiment of the present invention can generate micro-sized bubbles and/or nano-sized bubbles, and generation of bubbles in a smaller size than the micro/nano-sized bubble is not excluded. Further, the term "micro-sized bubble generator" used in the specification should be understood as a generator generating not only "micro-sized bubbles" but also generating "micro-sized bubbles and/or nano-sized bubbles" and/or "bubbles smaller than the nano-sized bubbles".

What is claimed is:

1. A micro-sized bubble generator using a highly-dissolved solution based on a rotating unit, comprising:

a rotating unit receiving a mixture of water and gas and discharging a solution while making the water and gas collide with each other and rotating the same;

a dissolving tank storing the solution discharged from the rotating unit; and a nozzle unit receiving the solution and generating micro-sized bubbles in the water, wherein the rotating unit comprises:

a rotating main body including a water/air inlet receiving the mixture of water and gas and a solution outlet discharging the solution; and a water/air rotation guide provided in the rotating main body, and inducing the mixture of the water and air having flowed into the rotating main body through the water/air inlet toward the outlet by rotating the mixture of the water and air to generate the solution, wherein the rotating main body is formed in the shape of a circular cylinder, the water/air inlet is formed along a tangent line direction of the rotating main body, and the solution outlet is formed in the center axis in the length direction of the rotating main body, and the water/air rotation guide comprises at least one water/air guiding wall provided in the rotating main body to allow the flow of water to the solution outlet from the water/air inlet, wherein the water/air guiding wall comprises a first wall/air guiding wall formed in the shape of a pipe, and a first end of the first water/air guiding wall is fixed to one side inner wall of the rotating main body where the solution outlet is formed while surrounding an area of the solution outlet, and a second end of the first water/air guiding wall is separately disposed from the other side inner wall disposed opposite to the one side inner wall of the rotating main body, wherein an inclined surface is formed in at least any one of the inner wall of the rotating main body and the first water/air guiding wall so that the inclined surface has a cross-section that is gradually decreased along a solution flow direction.

2. The micro-sized bubble generator of claim 1, further comprising a separation chamber connecting the rotating unit and the dissolving tank and separating air that is not dissolved in the solution.

3. The micro-sized bubble generator of claim 2, wherein the separation chamber is formed in the shape of a circular cylinder and the center axis of the separation chamber is disposed along the center axis of a flow direction of the solution discharged from the rotating unit.

4. The micro-sized bubble generator of claim 1, wherein the nozzle unit comprises:

a nozzle main body including a nozzle inlet through which the solution discharged from the dissolving tank flows in and a nozzle outlet discharging the micro-sized bubbles; and a solution rotation guide provided in the nozzle main body and inducing the solution having flowed into the nozzle main body through the nozzle inlet toward the nozzle outlet by rotating the solution to generate micro-sized bubbles in the solution.

5. The micro-sized bubble generator of claim 4, wherein the nozzle main body is formed in the shape of a circular cylinder, the nozzle inlet is formed in a tangent line direction of the nozzle main body, and the nozzle outlet is formed in the center axis in a length direction of the nozzle main body.

6. The micro-sized bubble generator of claim 5, wherein the solution rotation guide comprises at least one solution guiding wall provided in the nozzle main body to allow flow of the solution to the nozzle outlet from the nozzle inlet.

7. The micro-sized bubble generator of claim 6, wherein the at least one solution guiding wall comprises a first solution guiding wall of which one end is fixed to one inner wall of the nozzle main body where the nozzle outlet is formed while surrounding the nozzle outlet and a second end is disposed at a distance from the other inner wall of the nozzle main body disposed opposite to the one side inner wall.

8. The micro-sized bubble generator of claim 1, wherein the dissolving tank comprises a vent discharging air that is not dissolved in the solution to the outside.

9. The micro-sized bubble generator of claim 1, further comprising a common pipe connected with the dissolving tank to provide a path for movement of water discharged from the dissolving tank, wherein the nozzle unit comprises a plurality of nozzles, and at least one of the nozzles is provided in the common pipe and generates bubbles by receiving water through the common pipe.

10. The micro-sized bubble generator of claim 1, further comprising a controller controlling a level of water stored in the dissolving tank, wherein the dissolving tank comprises a tank main body provided with an inlet for receiving water supplied from the rotating unit and an inlet for receiving gas and a spray nozzle spraying water having flowed in through the inlet for receiving water to an upper portion, and the controller controls the amount gas flow into the tank main body to prevent the level of water stored in the tank main body from being higher than the spray nozzle.

11. The micro-sized bubble generator of claim 10, wherein the dissolving tank comprises:

a first level sensor sensing whether water reaches a first height h1; and a second level sensor sensing whether water exists at a second height h2 that is lower than the first height h1, and the controller controls the amount of gas flow into the tank main body based on the sensing result of the first and second level sensors.

12. The micro-sized bubble generator of claim 1, wherein the nozzle unit comprises:

a collision-type two-phase flow generator generating two-phase flow by receiving the solution and mixing the water and the gas while colliding with each other; and a collision-type nozzle unit connected to a rear end of the collision-type two-phase flow generator with respect to a flow direction of the two-phase flow, and including a plurality of balls generating micro-sized bubbles from collision with the two-phase flow.

13. The micro-sized bubble generator of claim 12, wherein the collision-type nozzle unit comprises:

a nozzle body coupled to the collision-type two-phase flow generator, and including a space formed therein to movably receive the plurality of balls; and a ball guide provided in the nozzle body to transmit the two-phase flow while preventing deviation of the balls.

14. A micro-sized bubble generator using a highly-dissolved solution based on a rotating unit, comprising:

a rotating unit receiving water and gas, and discharging a solution while making the water and the gas collide with each other and rotating the same;

a dissolving tank storing the solution discharged from the rotating unit; and a nozzle unit receiving the solution and generating micro-sized bubbles in the water, wherein the rotating unit comprises:

a device main body including an air inlet through which air flows in, a water inlet through which water flows in at a location different from the air inlet, and a water outlet through which water in which micro-sized bubbles are generated from interaction of the inflow air and inflow water is discharged; and a rotating guide provided in the device main body and guiding the water having flowed into the device main body toward the air having flowed in through the air inlet by inducing rotation of the water, wherein the device main body is formed in the shape of a circular cylinder, the water inlet is formed along a tangent line direction of the device main body, and the water outlet is formed in the center axis in the length direction of the device main body, the rotating guide comprises at least one guiding wall provided in the device main body to allow the flow of water to the water outlet from the water inlet, wherein the guiding wall comprises a first guiding wall formed in the shape of a pipe, and a first end of the first guiding wall is fixed to one side inner wall of the device main body where the water outlet is formed while surrounding an area of the water outlet, and a second end of the first guiding wall is separately disposed from the other side inner wall disposed opposite to the one side inner wall of the device main body, wherein an inclined surface is formed in at least any one of the inner wall of the device main body and the first guiding wall so that the inclined surface has a cross-section that is gradually decreased along a water flow direction.

15. The micro-sized bubble generator of claim 14, wherein the rotating unit further comprises a porous air guiding member coupled to the air inlet area.

16. The micro-sized bubble generator of claim 2, wherein the rotating unit and the separation chamber are provided in the dissolving tank.

* * * * *